United States Patent [19]

Focke

[11] 4,084,393

[45] Apr. 18, 1978

[54] APPARATUS FOR MAKING AND FILLING HINGED BOXES OF A FOLDABLE MATERIAL

[75] Inventor: Heinz Focke, Verden, Aller, Germany

[73] Assignee: Focke & Pfuhl, Verden, Aller, Germany

[21] Appl. No.: 606,826

[22] Filed: Aug. 21, 1975

[30] Foreign Application Priority Data

Aug. 21, 1974 Germany ..... 2440006

[51] Int. Cl.[2] ..... B65B 19/20

[52] U.S. Cl. ..... 53/137; 53/183; 53/195; 53/207; 93/51 R

[58] Field of Search ..... 53/183, 186, 194, 195, 53/207, 234, 253, 137; 93/39.2, 51 R, 51 HW

[56] References Cited

U.S. PATENT DOCUMENTS

| | | | |
|---|---|---|---|
| Re. 28,813 | 5/1976 | Davies et al. | 53/183 X |
| 1,169,012 | 1/1916 | Craggs | 53/195 X |
| 3,802,325 | 4/1974 | Bardenhagen et al. | 53/148 X |
| 3,956,865 | 5/1976 | Schmermund | 53/148 X |
| 3,977,157 | 8/1976 | Davies et al. | 53/207 |

FOREIGN PATENT DOCUMENTS

| | | | |
|---|---|---|---|
| 1,032,677 | 6/1966 | United Kingdom | 53/194 |

*Primary Examiner*—Robert Louis Spruill
*Attorney, Agent, or Firm*—Sughrue, Rothwell, Mion, Zinn and Macpeak

[57] ABSTRACT

There is provided a method and apparatus of making and filling a hinged box of a foldable material, more particularly cardboard, especially a hinged box for cigarettes, which box comprises a blank with front, rear and end walls, side walls formed from lateral flaps and a hinged lid. The end wall and front wall and the lateral flaps thereof are first simultaneously folded by movement of the blank in relation to folding tools into a position perpendicular to the rear wall and part of the blank adjoining the rear wall and thereafter further foldings are performed by the movement of folding tools in relation to the already partially folded blank.

84 Claims, 22 Drawing Figures

APPARATUS FOR MAKING AND FILLING HINGED BOXES OF A FOLDABLE MATERIAL

The invention relates to a method and apparatus for making and filling hinged boxes of a foldable material, more particularly cardboard, preferably for cigarettes comprising a blank with front, rear and end walls, side walls formed from lateral flaps, and a hinged lid.

Hinged boxes of the kind specified are very familiar and widely used as cigarette containers. They are also known as hard box packets or hinged lid packets. Disposed on a packet body is a hinged lid which is pivotably connected to its rear wall and in the closed position completes the body of the box to produce its rectangular shape. In the zone of the front wall the body of the box has a collar which is connected to the front wall and the side walls formed by interconnected lateral flaps and which extends beyond the top limit of the front wall and side walls and in the closure position extends via the projecting part into the hinged lid.

The manufacture and filling of hinged boxes of the kind specified made of a blank which is one part except for the collar is complicated and requires a very expensive mechanical packing machine to enable the manufacture and filling of such packets to be performed with the desired output usual in the cigarette-making industry.

It is an object of the invention to provide a packing method and an apparatus for the manufacture and filling of hinged boxes of the kind specified, more particularly for cigarettes, which gives a high output of perfect packets while calling for only inexpensive machinery.

The method for the solution of this problem is characterised in that the first the end wall and front wall and the lateral flaps thereof are simultaneously folded by the movement of the blank in relation to the folding tools, more particularly by a downward movement, into a position perpendicular to the rear wall and parts of the blank adjoining the rear wall, whereafter further foldings are performed by the movement of folding tools in relation to the blank.

In the method, end corner flaps adjoining the lateral flaps of the rear wall and connecting the same to the end wall are folded by the relative movement of the blank in relation to fixed folding tools through 90° around a horizontal and a vertical axis into an upright position in which they bear against the inside of the end wall, also folded into an upright position.

The special feature of the method is that the blank, which is one piece except for the collar and is at first flat, is given a very substantial partial folding by a relative movement in relation with specially constructed fixed folding tools into the pocket of an intermittently rotating turret, such pocket being disposed below the folding tools. The blank, received after this relative movement in relation to the fixed folding tools by the pocket in the turret, has an angular shape in an imaginary longitudinal section through the blank in the radial direction of the turret. In cross-section — i.e., sectioned parallel with the tangent of the turret — the packet therefore acquires a U-shaped folded cross-section.

The subsequent foldings of the packet (blank) are performed by folding tools disposed fixed in relation to the intermittently rotating turret, until after being substantially finished the packet leaves the turret. During an intermediate position the contents of the packet, more particularly a cigarette block with an inner blank (tinfoil blank) are fed in the radial direction, the inner blank being completely folded, immediately before entry into the partially folded packet, during such feed of the cigarette block.

According to another feature of the method according to the invention packs can also be produced having two packets consisting of cigarette blocks wrapped in a separate inner blank. According to this method the cigarette blocks are fed transversely spaced-out to the appropriate station of the turret and moved together by a transverse movement before entering the partially folded packet, the inner blanks of the cigarette blocks being completely folded during this final phase of their feed.

The apparatus according to the invention for the manufacture and filling of hinged boxes of the kind specified consists of a number of units through which the packet (blank) passes. The main component of the apparatus is a first turret consisting of a horizontal disc which can rotate intermittently around a vertical axis and which has disposed on its outer periphery a number of radially outwardly and upwardly open pockets of U-shaped cross-section, each pocket receiving a blank (packet). This turret, in and on which the majority of the folding operations take place, is adjoined by a packet path with a glue-applicator. The packing path extends to a further turret (transfer turret) which transfers the completely folded packets to a drying turret in which the packets are stored in a large number of turret pockets for an adequate period. After the packets have been dried they are returned by the drying turret to the transfer turret which feeds the finished packets to a packet conveyor.

Further details of the apparatus will now be described in greater detail with reference to examples of the packet blanks illustrated in the drawings and an embodiment of the apparatus. In the drawings.

Figure 8:
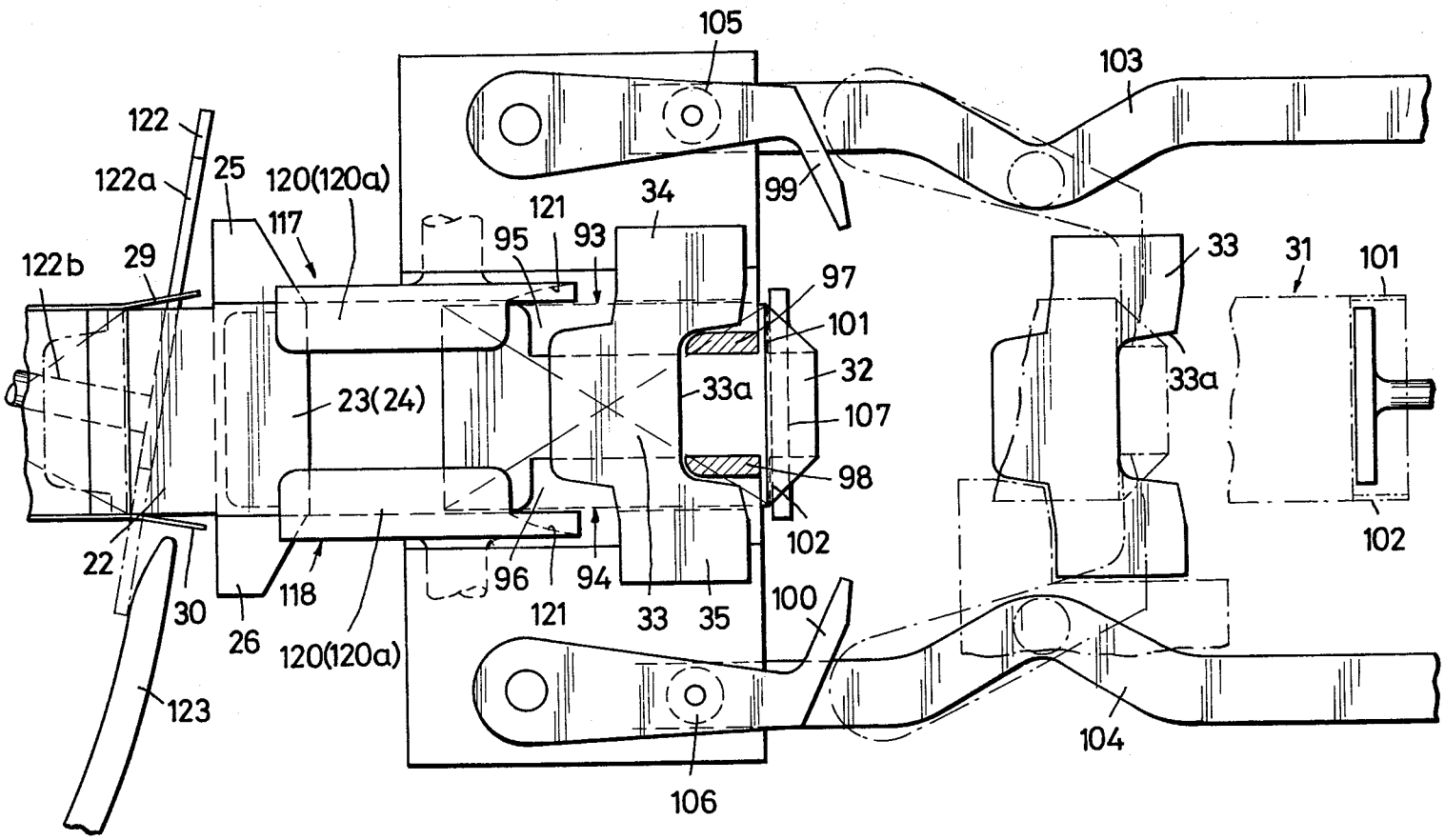
FIG. 8 is a plan view to an enlarged scale in the zone of a folding station III with different positions of folding tools.
Figure 8A:
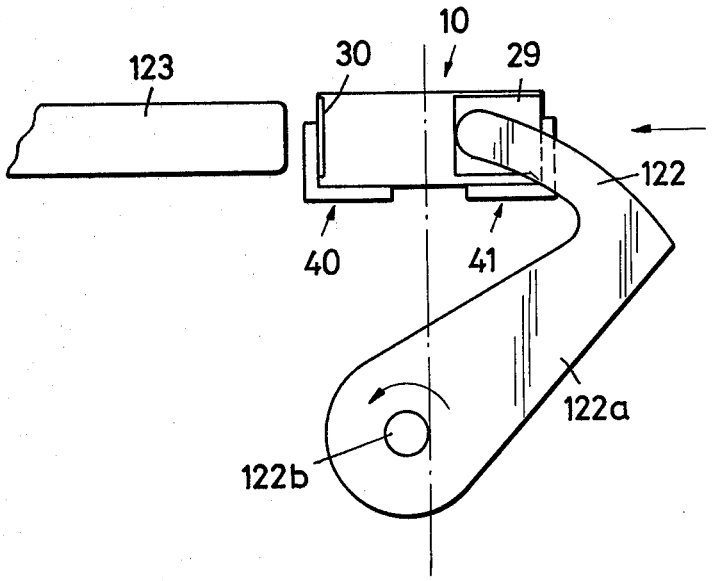

FIG. 8*a* shows a detail in the zone of a folding station III, with an end view of the turret, omitting irrelevant details.

Figure 9:
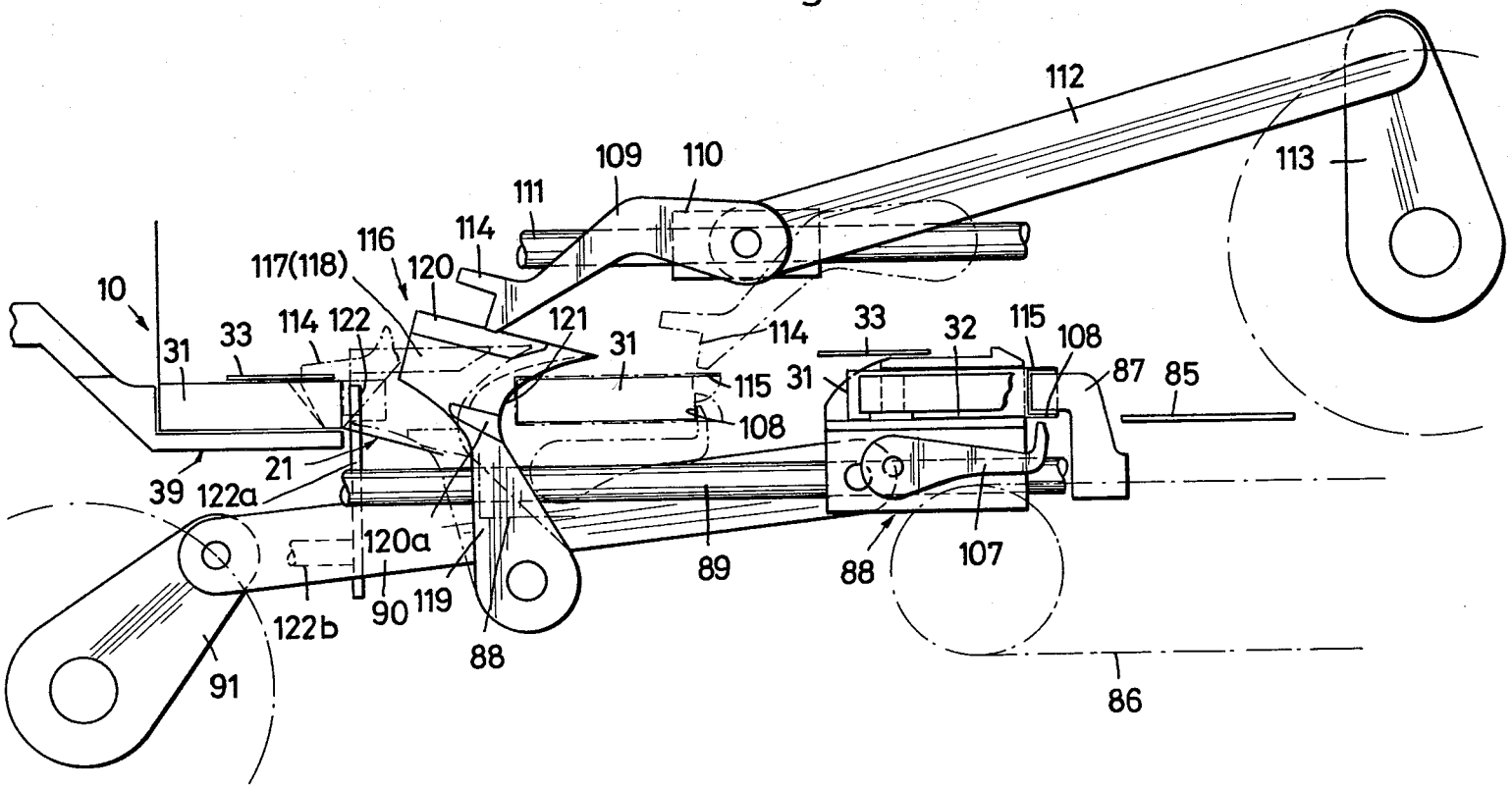

FIG. 9 is a side elevation of the folding station illustrated in FIG. 8, also with different positions of the folding tools and extra folding tools as against FIG. 8.

Figure 3:
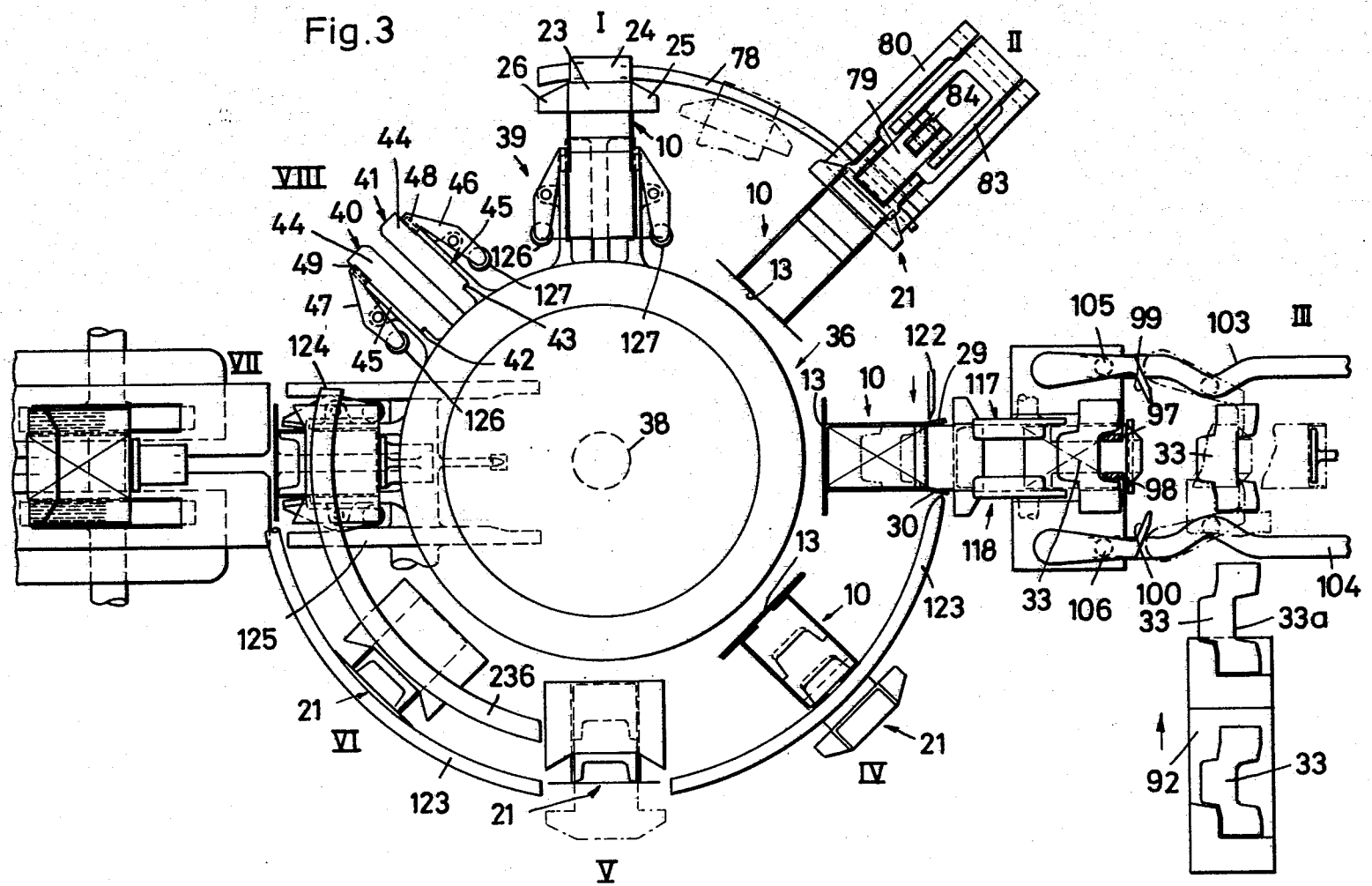
FIG. 3 is a diagrammatic plan view of a turret before performing the majority of the folding operations in the manufacture of the packet.
Figure 10:
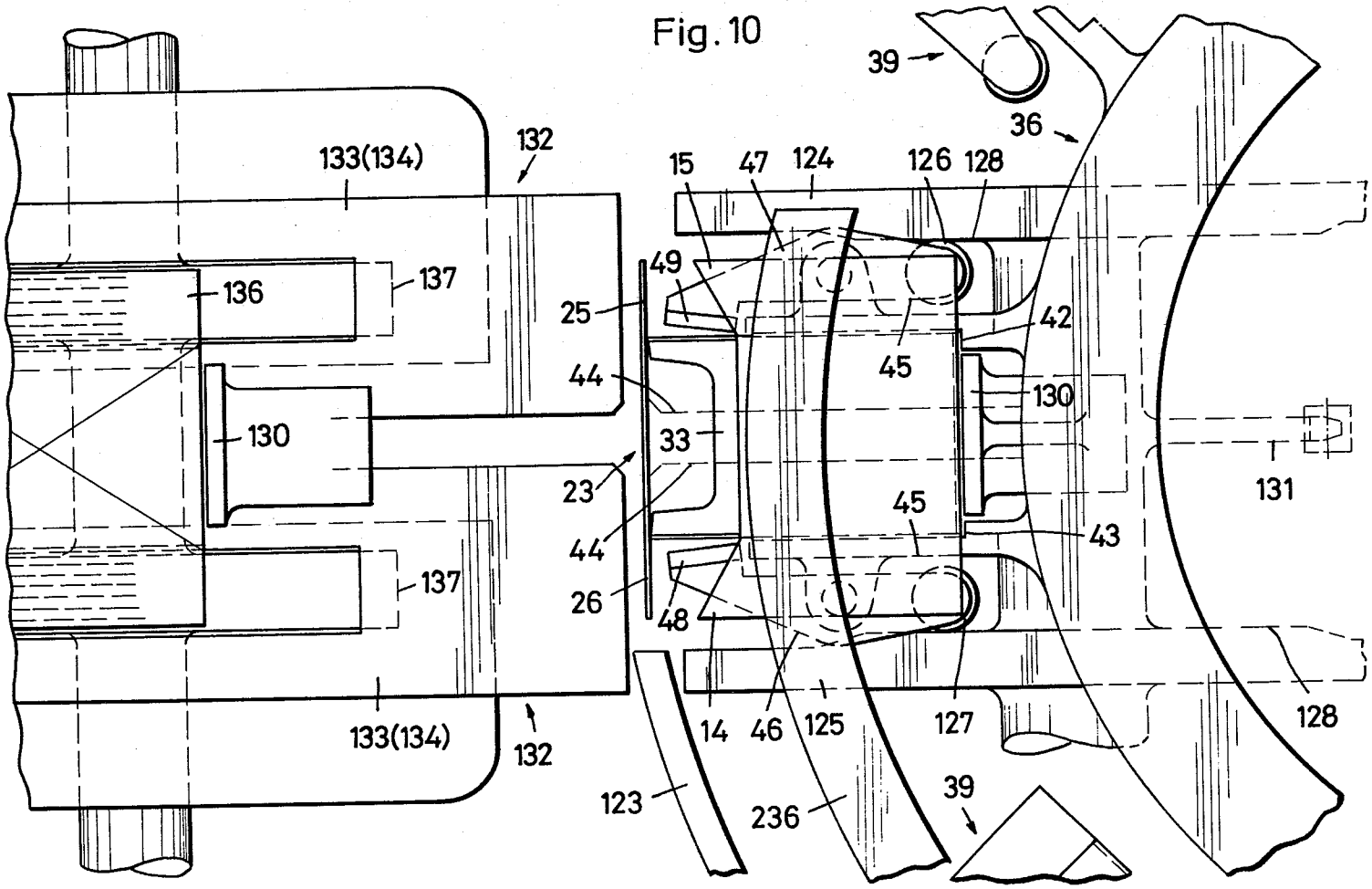

FIG. 10 shows in diagrammatic plan view to an enlarged scale the ejection station VII of the turret illustrated in FIG. 3.

Figure 11:
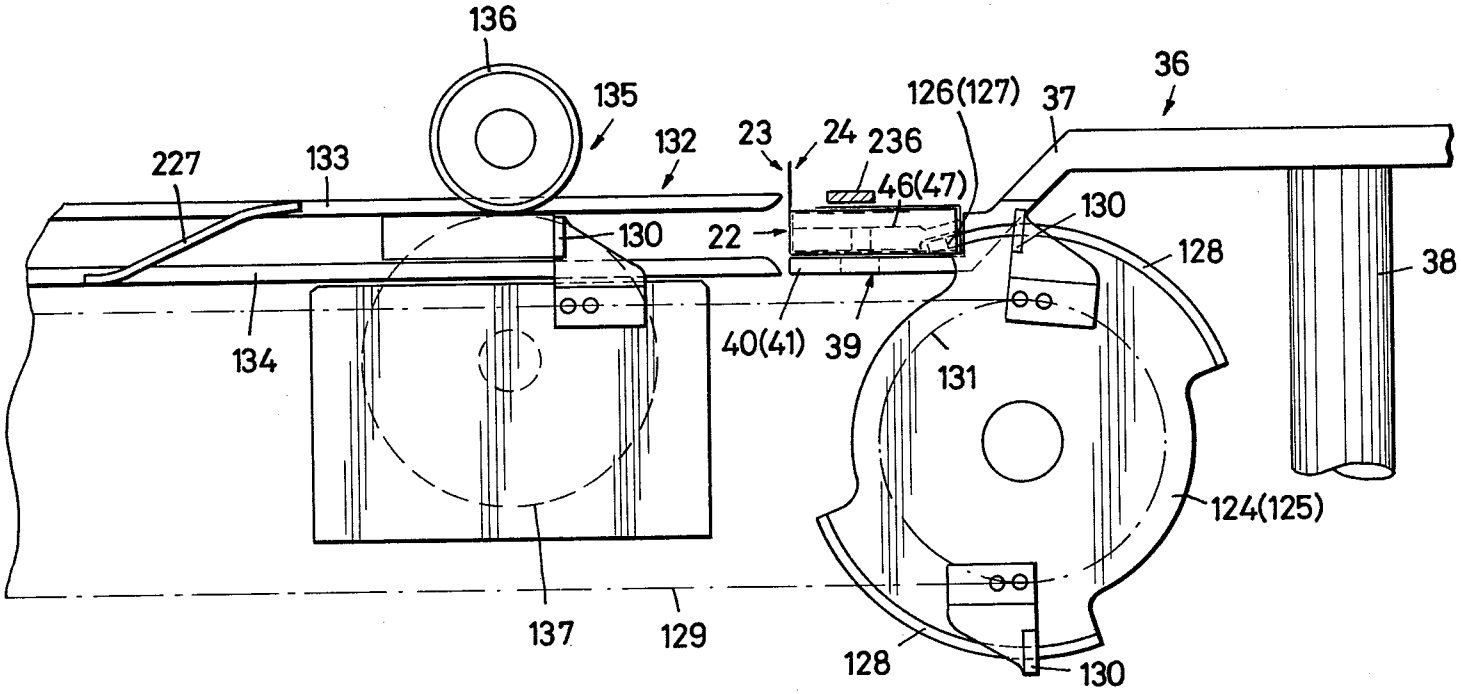

FIG. 11 is a side elevation to a reduced scale corresponding to FIG. 10.

Figure 12:
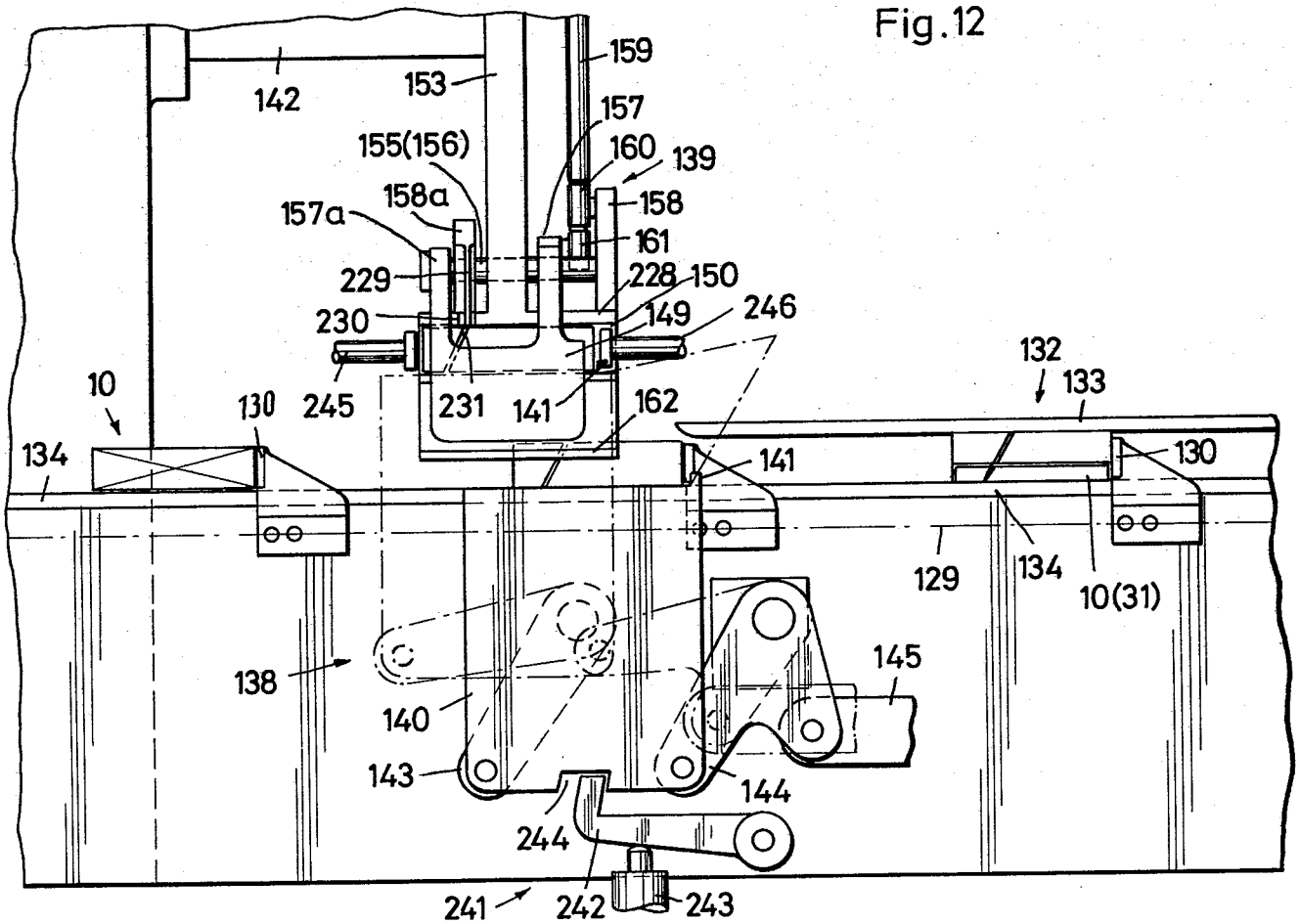

FIG. 12 is a side elevation of a part of the packing machine adjoining the first turret, namely a transfer to a further turret (transfer turret).

Figure 13:
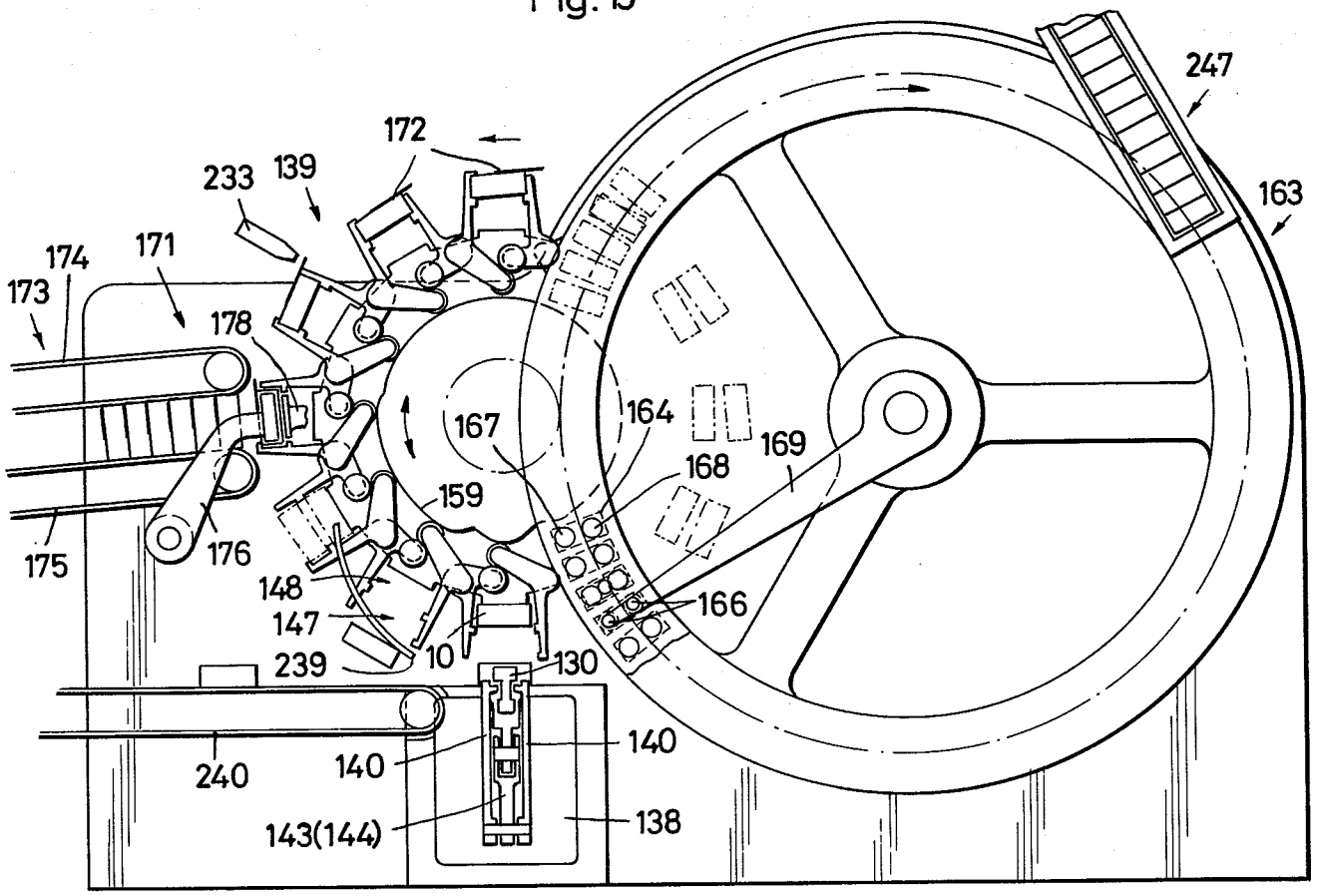

FIG. 13 is a diagrammatic side elevation of a drying turret adjoining the transfer turret, which is shown shifted through 90° in comparison with FIG. 11.

Figure 14:
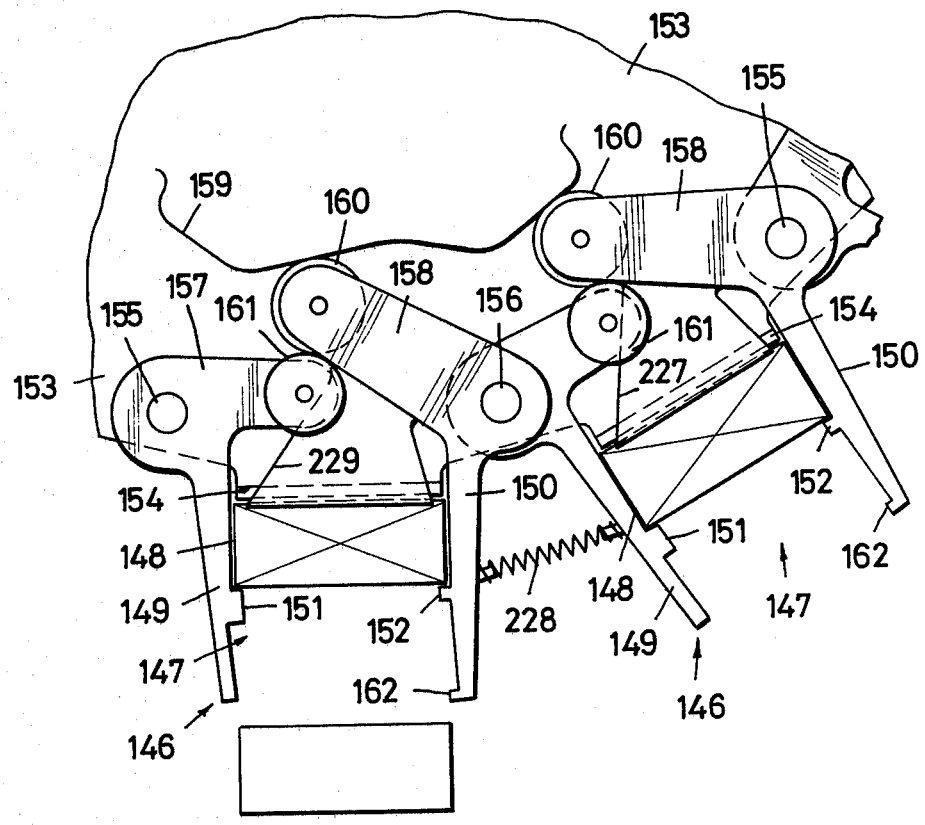

FIG. 14 is a detail to an enlarged scale of the transfer turret illustrated in FIG. 13.

Figure 15:
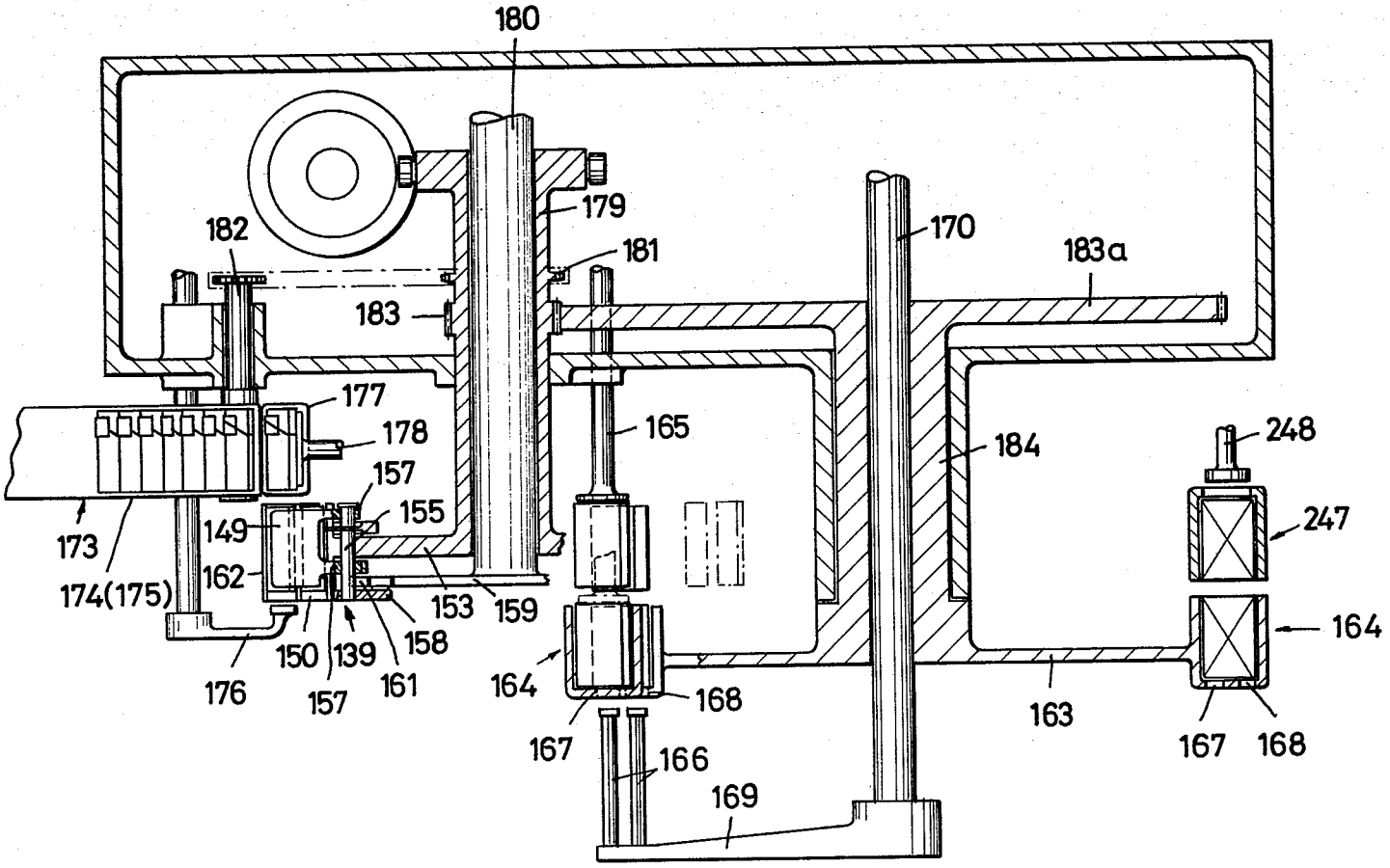

FIG. 15 is a horizontal section and plan view corresponding to FIG. 13.

Figure 16:
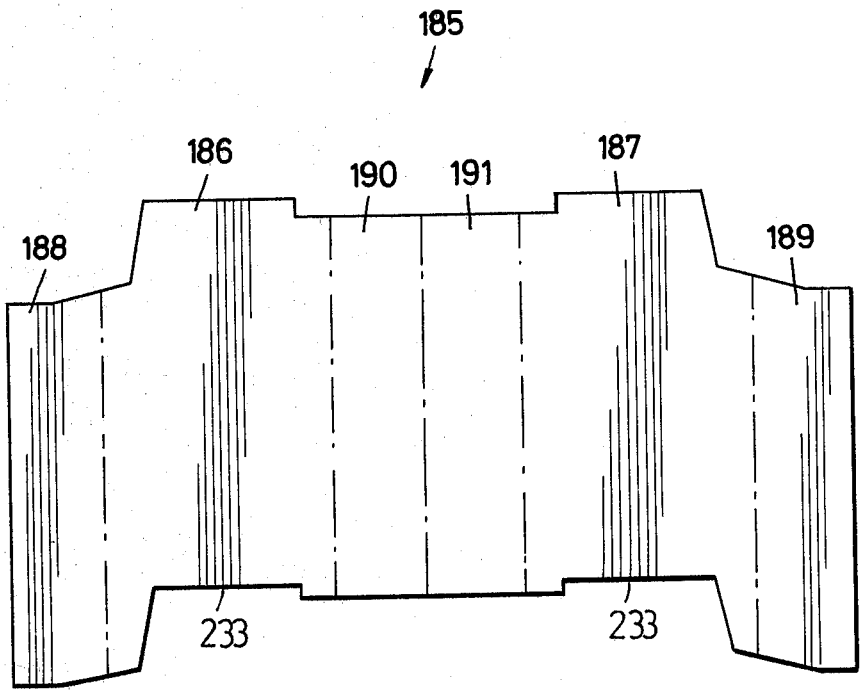

FIG. 16 shows in the spread-out condition a double collar for making a hinged box having two cigarette blocks and a collar extending over both blocks.

Figure 17:
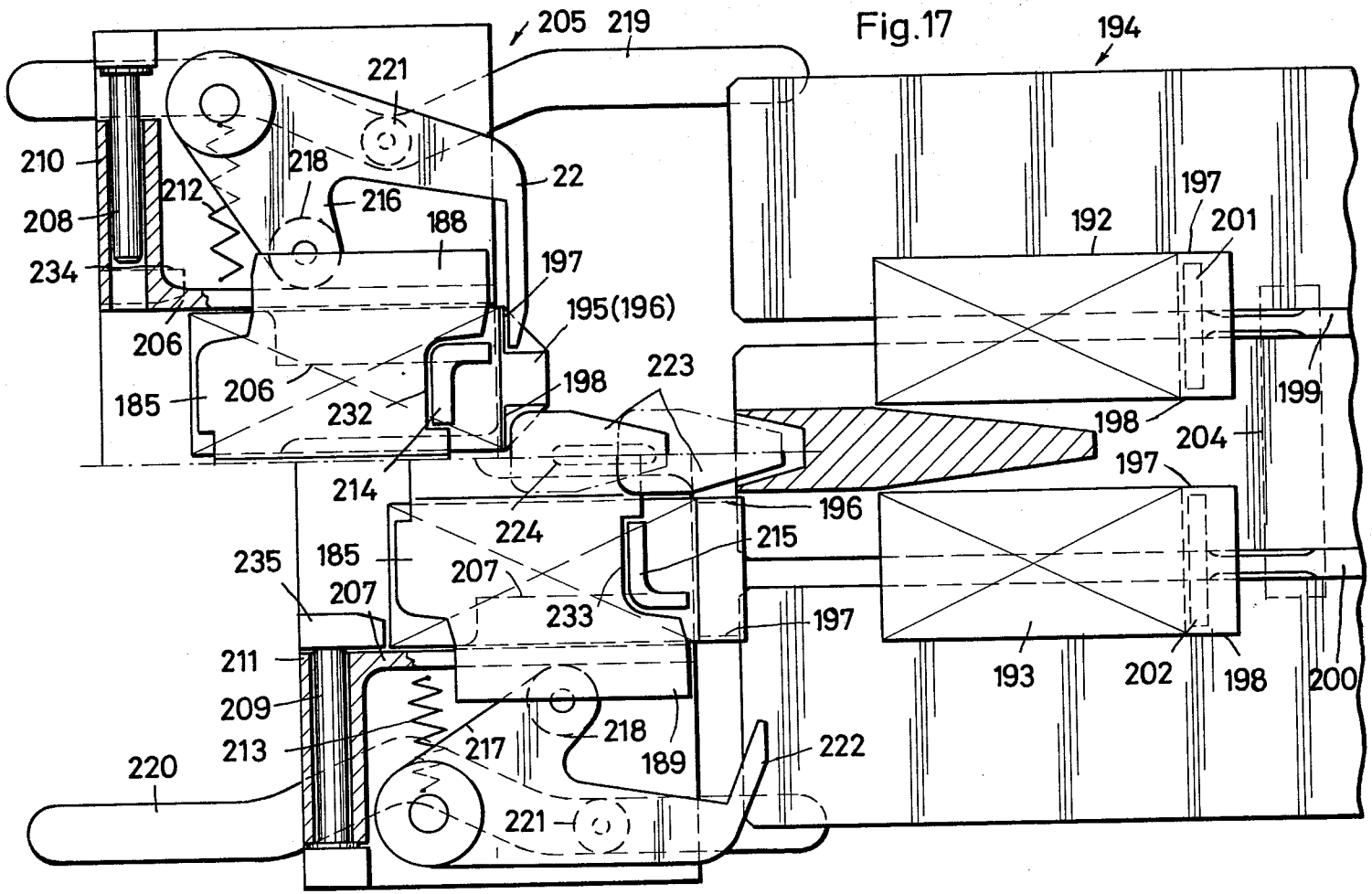

FIG. 17 is a plan view of a variant construction of the folding tools illustrated in FIG. 3 for manufacturing hinged boxes with two cigarette blocks, in a different positin of parts of the apparatus.

Figure 18:
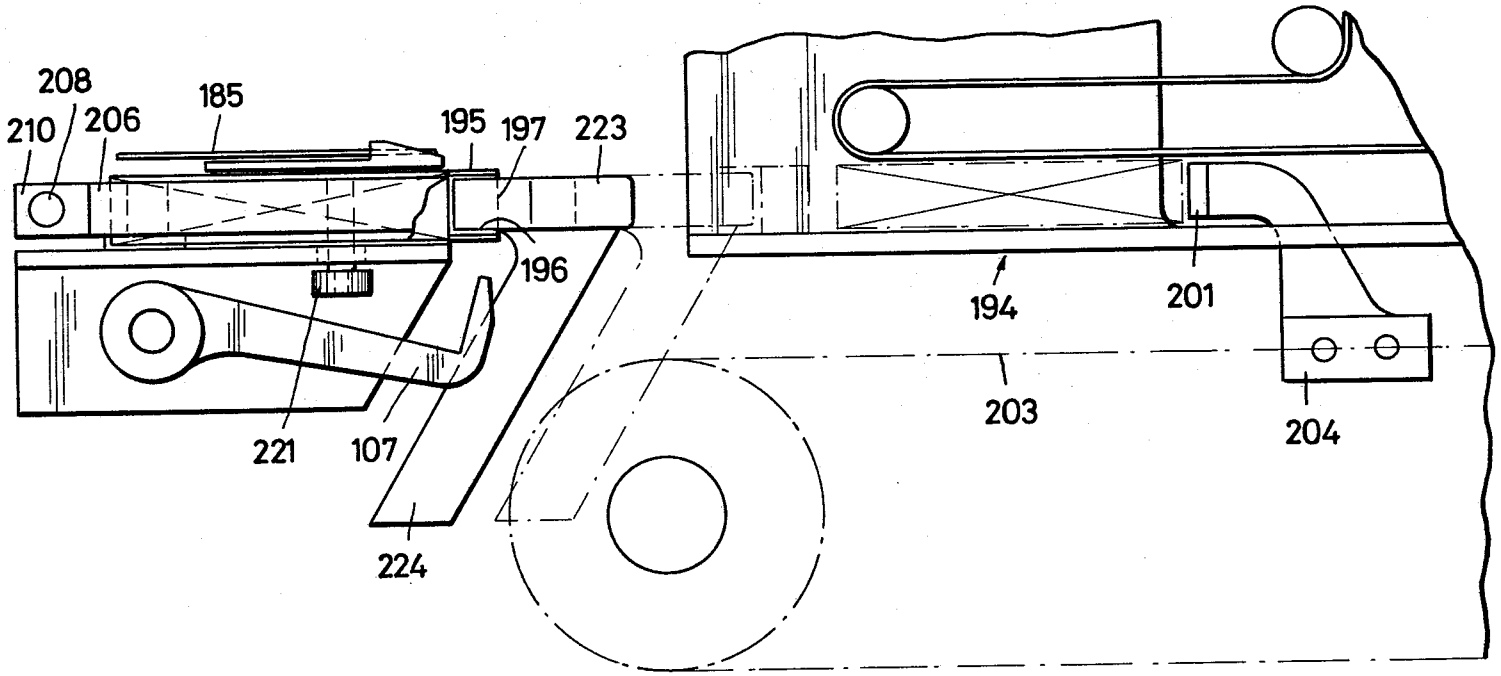

FIG. 18 is a side elevation corresponding to FIG. 17.

Figure 19:
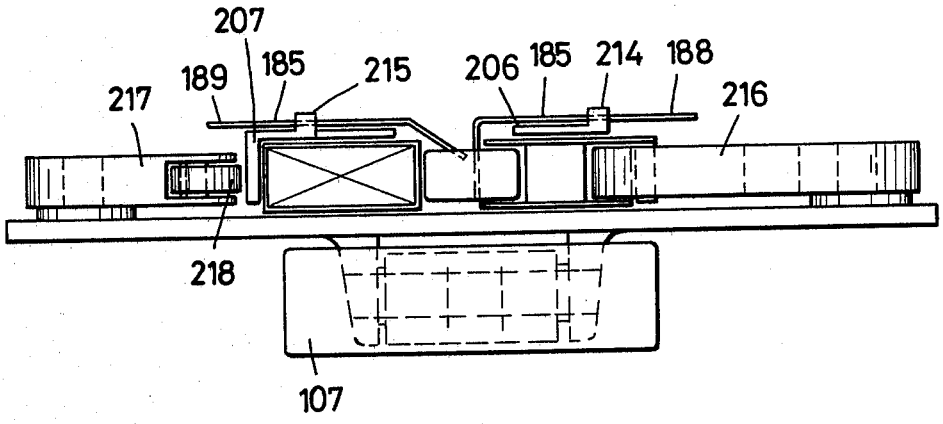

FIG. 19 is an end view corresponding to FIGS. 17 and 18.

Figure 20:
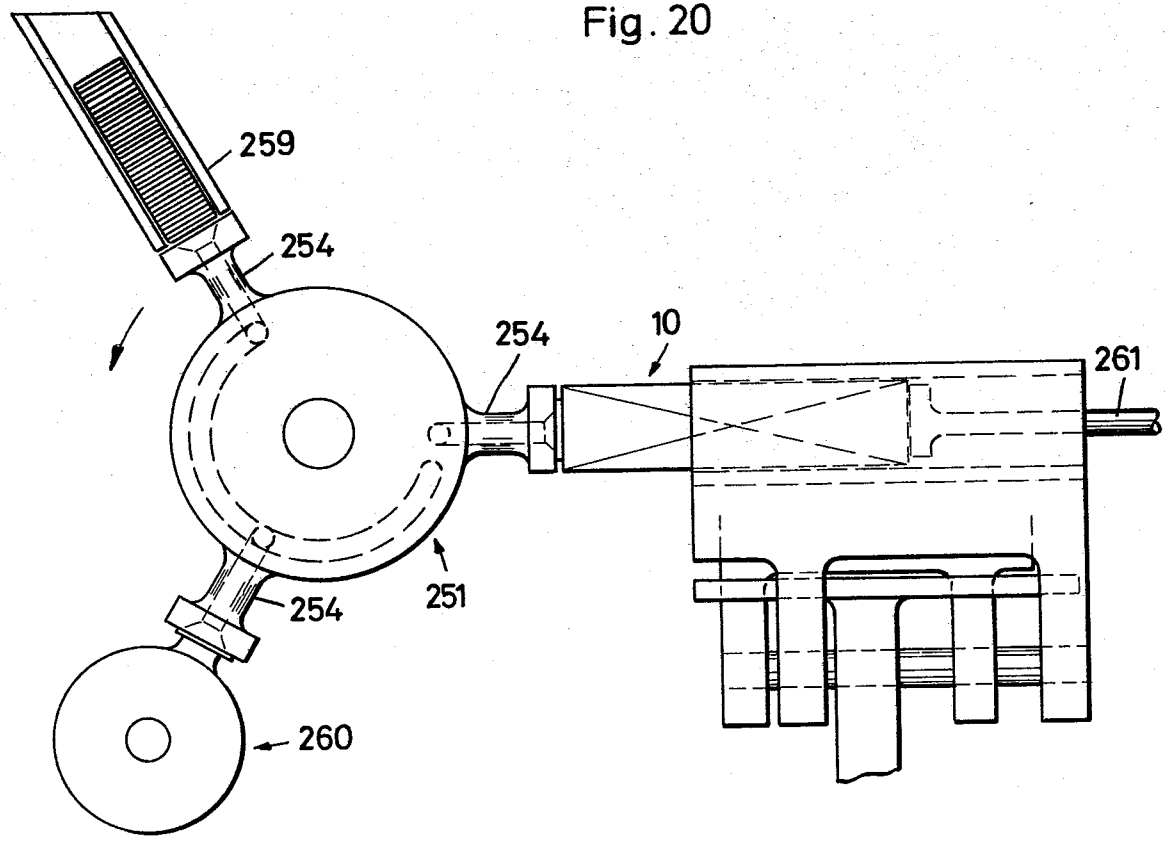

FIG. 20 is a side elevation of a wrapper-applying device operating more particularly in the zone of the transfer turret 139.

Figure 21:
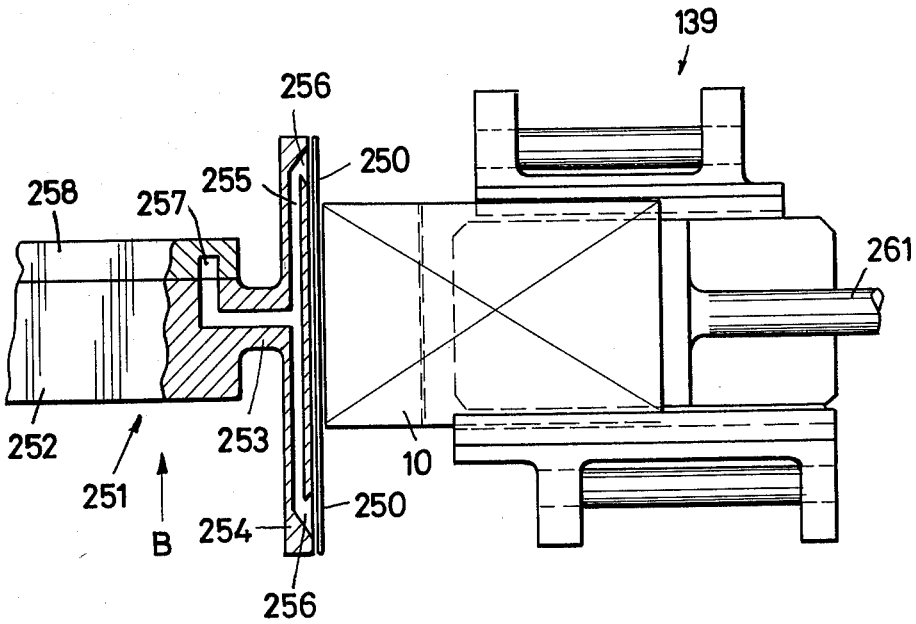

FIG. 21 is a partially sectioned plan view to an enlarged scale of a detail of the apparatus illustrated in FIG. 20.

The packing machine according to the invention is used for manufacturing and filling rectangular folded boxes, more particularly boxes having a hinged lid articulated to a rear wall. Hard box packets of this kind mainly receive cigarettes.

Figure 1:
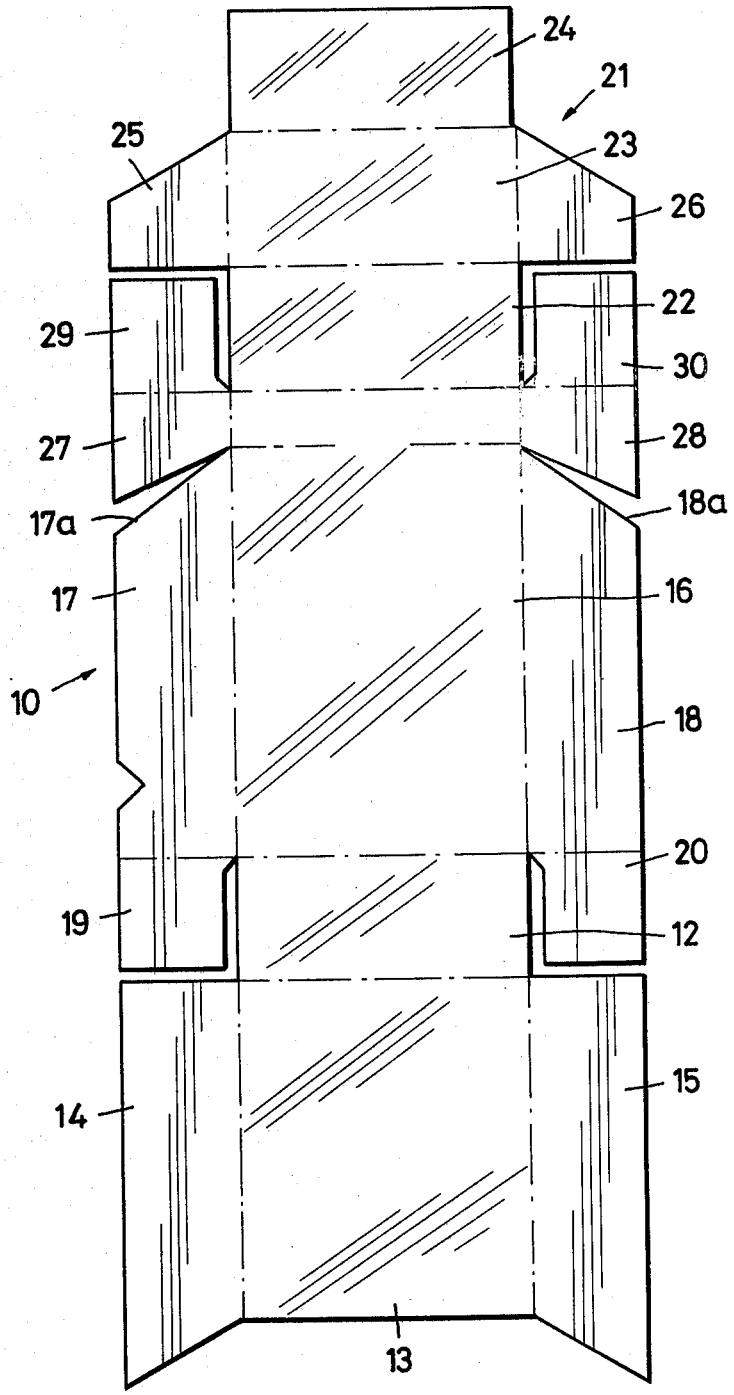
FIG. 1 shows a spread-out blank for a box with a hinged lid, but without a collar.

FIG. 1 shows a spread-out blank 10 for a cigarette packet of the kind specified having a hinged lid. The blank is completed by a separated collar which is added to that part of the packet formed by the blank illustrated in FIG. 1.

Figure 2:
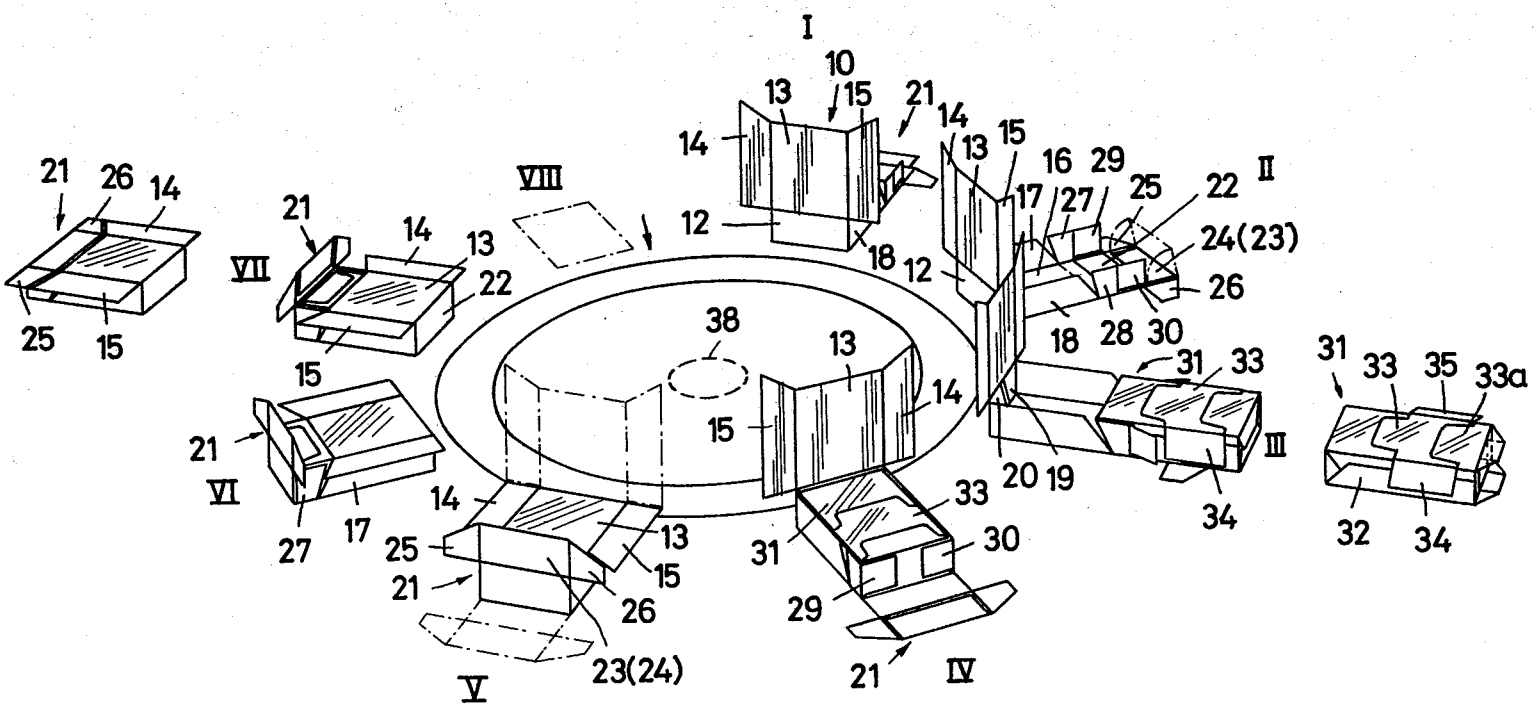
FIG. 2 is a perspective view of a folding scheme showing the succession of folding operations in the packing machine according to the invention.

The construction and folding geometry of this conventional hinged lid packet will be described hereinafter with reference to the diagrammatic FIG. 2 which shows in perspective the folding stations through which the blank 10 (FIG. 1) — i.e., the packet in its various stages of folding — passes.

The blank 10 (FIG. 1) is fed intermittently to the individual folding stations disposed along the arc of a circle.

At the folding station I the spread-out blank 10 (FIG. 1) is taken over by a separate blank path 11 (FIG. 4) disposed above the plane of the folding stations. The blank 10 is fed from above to the folding station I. During the downward movement of the blank 10 an end wall 12, with an adjoining front wall 13 and lateral flaps 14, 15 disposed laterally on the front wall 13, is folded into an upright position. A rear wall 16 of the packet, adjoining the end wall 12, is folded horizontally — i.e., at a right angle thereto. Lateral flaps 17, 18 disposed laterally on the rear wall 16 are also folded into an upright position in relation to the rear wall 16. End corner flaps 19, 20 adjoining the lateral flaps 17, 18 are also folded simultaneusly around a horizontal and vertical axis and bear against the inside of the upright end wall 12. At the folding station I the blank therefore forms an angular profile with a radial section, and a U-shaped construction with a cross-section or tangential section.

In the radial outward direction the bottom rear wall 16 is adjoined by blank parts to form a hinged lip 21, namely a front wall 22, a lid front wall 23 and an inner flap 24 to folded into the lid. In the zone of the lid front wall, outer gussets 25, 26 adjoin laterally, which register with inner gussets 27, 28 when the packet is completely folded. Lid corner flaps 29, 30 are connected to the inner gussets 27, 28 as further parts of the hinged lid 21.

Out of the aforementioned blank parts of the hinged lid 21, at the folding station I the inner gussets 27, 28 with the lid corner flaps 29, 30 disposed thereon are folded into an upright position — i.e., into the same plane as the lateral flaps 17, 18.

At the folding station II the inner flap 24 of the hinged lid 21, to which glue has been applied, is folded over through 180° against the upwardly pointing side of the lid front wall 23. During conveyance of the blank out of the folding station I into the folding station II the inner flap 24 is already raised out of the flat position, the folding operaton of folding station II therefore being prepared.

Relatively complicated folding and filling operations are performed at the folding station III, to which partially folded cigarette blocks 31 are fed. These are groups of cigarettes which are each associated with one cigarette packet and are enclosed on the outside by a blank, more particularly a tinfoil blank 32, which is on the inside of the finished packet. The tinfoil blank 32 is laid in the longitudinal direction of the cigarettes in U-shape around the cigarette group. End flaps project beyond the cigarette group on the rear side, as viewed in the conveying direction. During the feed of the cigarette block 31 to the partially folded packet 10 held in readiness at the folding station III, the end flaps are folded against the contents of the packet, so that the cigarette block 31 is completed.

A collar 33 which is cut to shape but not yet folded is also introduced into the folding process in the zone of the folding station III. The collar 33, which is still flat, is laid on the top side of the cigarette block 31 and fed together therewith to the open packet. At the same time laterally projecting collar flaps 34, 35 are folded against the side surfaces of the cigarette block 31.

After the cigarette blocks 31 with the folded-over collar 33 has been inserted into the radially and outwardly open packet, the resulting unit is fed to folding station IV. During conveyance from the folding station III to the folding station IV, the lid corner flaps 29, 30 disposed on the inner gusset 27, 28 are folded over against the outwardly pointing end face of the cigarette block 31. Also at the folding station IV, the collar 33 applied at the folding station III set back in relation to the end face of the cigarette block is moved into the end position, namely into abutment with the folded-over lid corner flaps 29, 30.

At the following folding station V, parts of the hinged lid 21, namely the lid front wall 23 with inner flaps 24 and outer gussets 25, 26, is folded into an upright position. Also the still upright front wall 13 with the lateral flaps 14, 15 disposed thereon is folded against the top side of the contents of the packet. Following the folding station V, above the pockets 39 in the turret 36, the top guide 236 is provided for retention of the parts of the blank folded over at the folding station V in the folding position — i.e., bearing against the cigarette block 31. The top guide 236 extends as far as the ejection of the packet out of the turret 36.

At the following folding station VI the packet remains unchanged.

Then comes folding station VII, at which the partially folded packet leaves the circular path by radially directed ejection. The ejection folds the still upright lead front wall 23, with the blank parts disposed thereon, into the horizontal position. The still laterally projecting lateral flaps 14, 15 (on the outside in the finished packet) of the front wall 13 and the outer gussets 25, 26 of the hinged lid 21 are glued on the underside and then folded over against the side surface of the packet, so that the packet is completed. All that is then needed is to apply a controlmark in the zone of the hinged lid 21.

Folding stations I–VII are formed by an intermittently-rotating turret 36 consisting of a flat, pot-shaped disc 37 disposed on a vertical shaft 38. The outer periphery of the disc 37 is formed with uniformly spaced-out, radially projecting pockets 39 each adapted to receive a packet or blank 10.

In this embodiment the pockets 39 are constructed with a horizontal bearing surface for the blank 10, namely for its downwardly pointing rear wall 16. To this end each pocket 39 comprises two carriers 40, 41 of angular cross-section which are spaced out and directed parallel with the imaginary radial. Bottom arms 44 of the carriers 40, 41 form the bearing surface for the blank 10. Corners 42, 43 of the arms 44 adjacent the disc 37 form the stops for the blank 10, namely for the upwardly folded end wall 12, lying at the center of the turret. The upright lateral arms 45 of the carriers 40 seize the upwardly-directed lateral flaps 17, 18 of the rear wall 16.

The upright arms 45 extend in a direction parallel with the radial of the turret only over the length of the lateral flaps 17, 18 — i.e., terminate in the zone of an incision between the lateral flaps 17, 18 on the one hand and the inner gussets 27, 28 also folded upwardly at the folding station I. In the zone of the inner gussets 27, 28, movable stop arms 46, 47 operate. They are two-armed levers pivotably mounted laterally on the carriers 41, 42, namely on the upright arms 45. The outer ends of the stop arms 46, 47 and retaining lugs 48, 49 which, during the folding operations — i.e., from the reception of the blank 10 until its ejection — seize a radially and outwardly pointing inclined edge 17*a*, 18*a* of the lateral flaps 17, 18. As a result the blank 10, folded to a varying extent, is fixed in the pocket 39, constantly varying at the corners 42, 43. The inclined rising course of the edges 17*a*, 18*a* fixes the blank 10 in two directions, namely radially outwards and upwards.

To reject the substantially folded packet 10 from the folding station VII, the stop arms 46, 47 loaded by a spring (not shown) are so pivoted that the retaining lugs 48, 49 are lifted off the edges of the lateral flaps 17, 18.

The turret 36 in this embodiment has eight pockets 39. If the blank 10 runs only through the folding stations I–VII, there is an empty section VIII.

The blanks 10 (FIG. 1) are fed to the turret 36 in the zone of the folding station I. Disposed above the turret 36 is a blank path 11 which is directed at an inclination to the disc 37 and on which the blank is conveyed by pairs of conveying rollers 52, 53 between the lateral top guide 50 and bottom guide 51. Disposed between the pairs of conveying rollers 52, 53 is a glue-applying roller 54 which cooperates with a matching roller 55 and transfers glue taken from a gluing apparatus 56 to the adjacent side of the blank 10.

The blank 10 is conveyed over the blank path as far as a transversely directed end stop 57 at which the edge of the blank 10 which is at the front, viewed in the conveying direction, is borne in a guide groove. The blank 10 is then so positioned inclined above the pocket 39 of the turret 36 in the zone of the folding station I, that the part of the blank 10 which forms the rear wall 16 lies above the pocket 39. To ensure this accurate relative position between the blank 10 and the pocket 39, which is required for the further folding operation, the blank is forced by an adjusting arm 58 (two-armed lever) into the exact bearing position at the end stop 57. To this end the adjusting lever 58 is so driven in horizontal reciprocation by a crank drive 59 that with a corresponding direction of movement a finger 60 is moved against that edge of the blank 10 which is at the rear viewed in the conveying direction.

The feed device for the blank also has a lateral aligning device 61 which also takes the form of a two-armed pivotable lever and can be pivoted against the loading of a spring around an axis 63. The lateral aligning device 61 bears by a lateral retaining member 64 against one lateral edge of the blank 10 in the end position.

Figure 4:
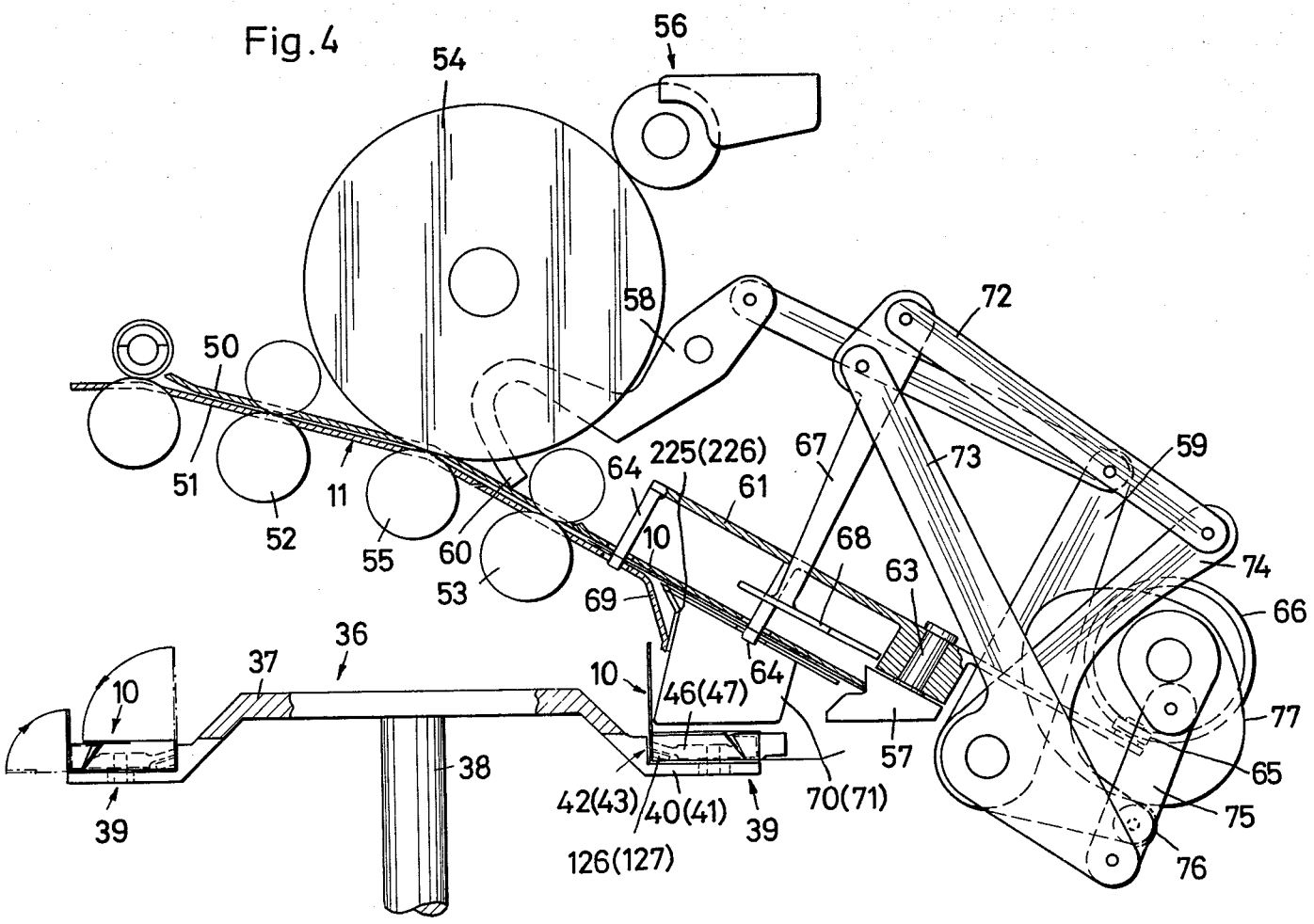
FIG. 4 is a side elevation and vertical section of a first folding station I of the turret in the FIG. 3.
Figure 5:
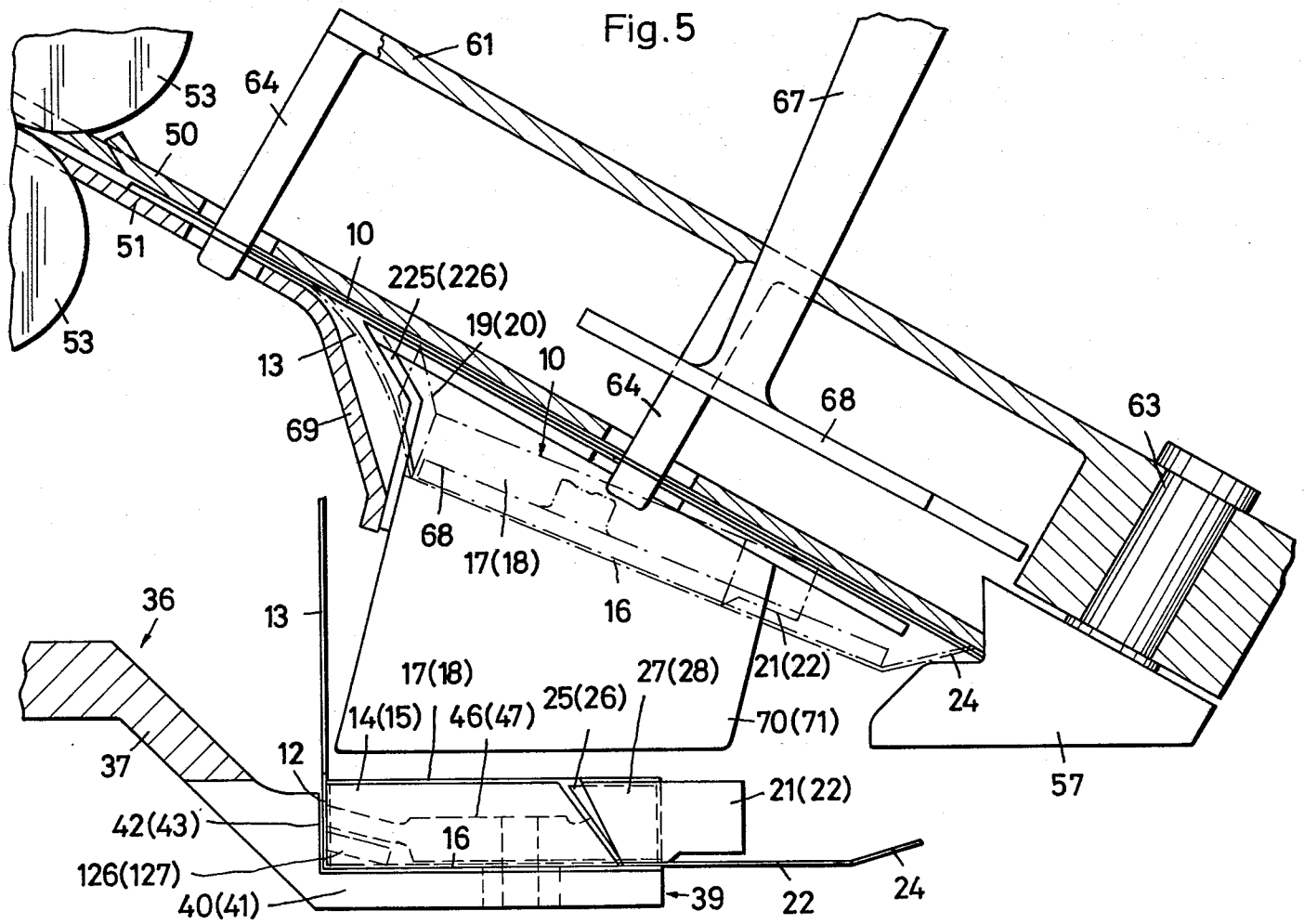
FIG. 5 is a detail to an enlarged scale of FIG. 4, with parts of the apparatus in a different relative position.
Figure 6:
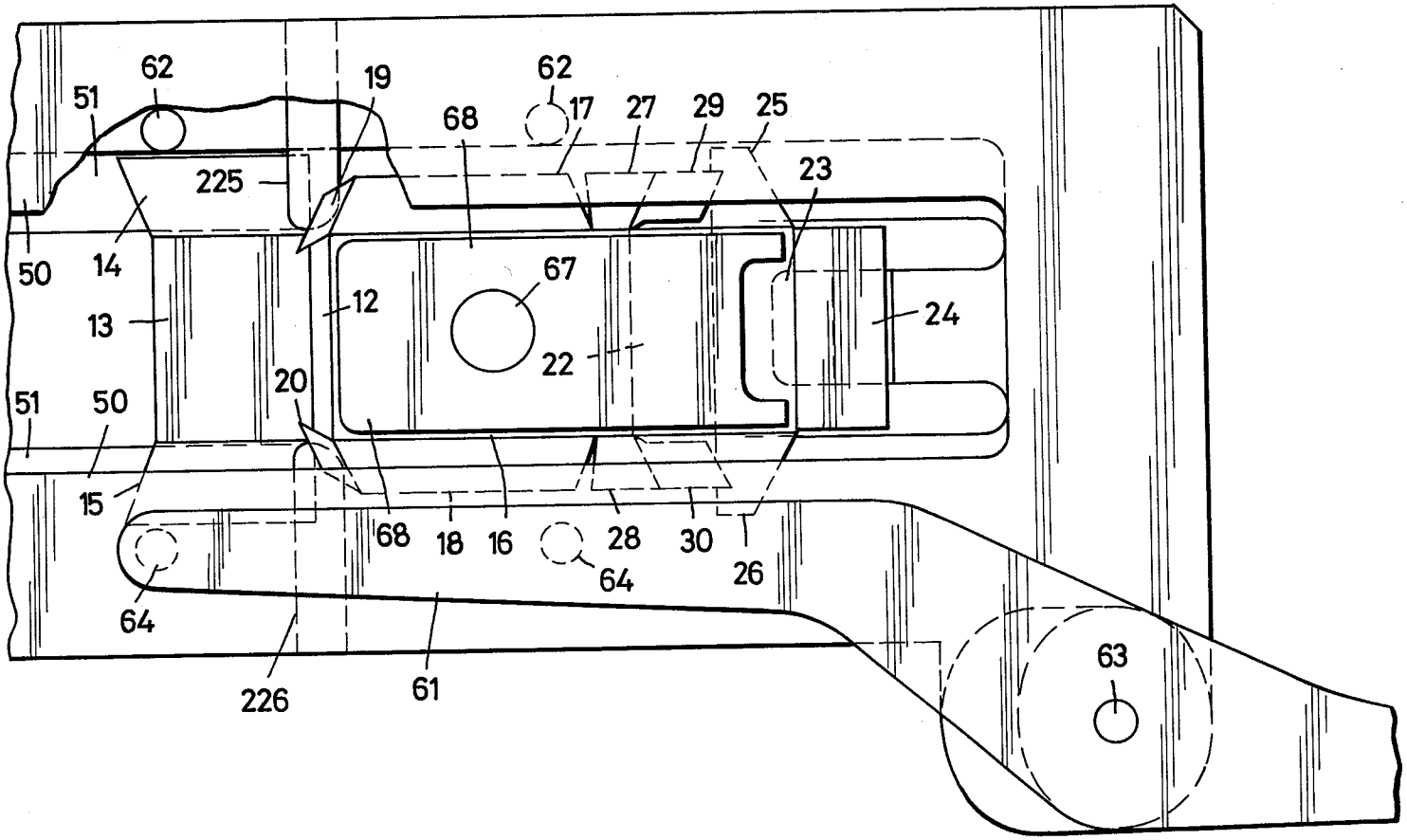
FIG. 6 is a detail in plan to an enlarged scale of the station I illustrated in FIG. 4.

Provided as a counter bearing for the blank are two spaced-out, thin-shaped lateral stops 62 for the opposite lateral edge of the blank (FIG. 6). When the blank 10 is introduced into this zone, the lateral aligning device 61 with its lateral retaining members 64 is pivoted back, controlled by a scanning roller 65, running on a pot cam 66 (FIG. 4).

The blank 10 thus aligned above the pocket 39 and the folding station 49 is forced by a punch 67 downwards into the pocket 39 of the turret 36. To this end the punch 67 as a punch plate 68 which, as a result of suitable dimensioning, seizes the rear wall 16 of the blank 10 over its whole area, and if necessary parts of the hinged lid 21. The punch 69 is moved downwards by a suitable transmission, entraining the blank 10, which is forced into the pocket 39.

Folding guides surrounding the pocket 39 on both sides and on the radially inner side are disposed above the pocket 39. The folding guides consist in this embodiment of a folding tongue 69 which is directed at an inclination, adjoins the bottom guide 51 of the blank path 11 and is downwardly directed at the pocket 39. The folding tongue 69 folds over the end wall 12 and the adjoining front wall 13 of the blank 10 when the latter is lowered into the pocket 39.

Disposed on both sides of the pocket 39, below the blank path 11, are obliquely directed, downwardly converging lateral retaining members 70, 71, which extend substantially over the whole length of the pocket 39 and beyond, and fold over the lateral flaps 17, 18 and also the inner gussets 27, 28 with the lid corner flaps 29, 30 disposed thereon into the upright position.

In the corner between the lateral folder 70, 71 on the one hand and the folding tongue 69 on the other, corner folders 225, 226 are inserted which, due to their arrangement and design perform the function of so seizing and inwardly folding the end corner flaps 19 and 20 when the blank 10 is lowered, that during the further course of proceedings the flaps 19, 20 are also directed upwards by the end wall 12 and are finally folded upright against the inside of the end wall 13.

The folding members 69; 70, 71; 225, 226 are so adapted to one another in design and relative position that when the blank 10 moves downwards, the end corner flaps 19, 20 are folded upwards into an inclined relative position by the punch plate 68 during the first phase of movement. At the same time a folding movement around two axes takes place. As a result the free parts of the end corner flaps 19, 20 are disposed above the end wall 12 bearing against the folding tongue 69.

As movement continues, the lateral flaps 17, 18 emerge from the lateral top guides 50 and bottom guides 51 bear freely against the lateral folding members 70 and 71. During a relatively long phase of the folding operation the front wall 13 and its side flaps 14 and 15 are retained between the top guide 50 and the bottom guide 51. As the downward movement increases, the lateral flaps 14, 15 directed in one plane with the front wall 13 enter the gap produced between the folding tongue 69 and the corner folding elements 225, 226 and are thus guided into the upright position.

The punch 67 and its punch plate 68 forces the rear wall 16 of the blank 10 as far as the horizontal arms 44 of the carriers 40, 41. The punch plate 68 then moves into the starting position in the following manner: the punch plate 68 is raised and moved radially outwards and again fed from outside and above to the blank path 11. This means that the movement is such that the punch plate 68, during its movement into the starting position, is not moved through the blank path 11, which it moves around radially on the outside. This movement is achieved by a system of links 72–75. The link 75 is driven after the fashion of a crank, while the link 74 runs by a running roller 76 on a cam disc 77.

After the blank 10 has been forced into the pocket 39, in the zone of the folding station 1, the turret 36 is moved on by one step, so that the body 39 arrives in the zone of the folding station II. During its movement from the folding station 1 into the zone of the folding station 2 the radially outer inner flap 24 of the hinge lid 21 is directed upwards by a fixed folding strip 28.

At the folding station II merely a relatively simple folding operation is performed, namely the folding over of the upwardly directed inner flap 24 against the lid front wall 23 of the hinged lid 21. This folding operation is performed by a folding lever 79 which is pivotably mounted in the form of a one-armed lever on a fixed base 80 outside the pocket 39. The folding lever 79 has a folding lug 81 which seizes the inner flap, the lug 81 pressing the inner flap 24 with a high pressure on to the lid front wall 23 lying on a projection 82 of the base 80.

Figure 7:
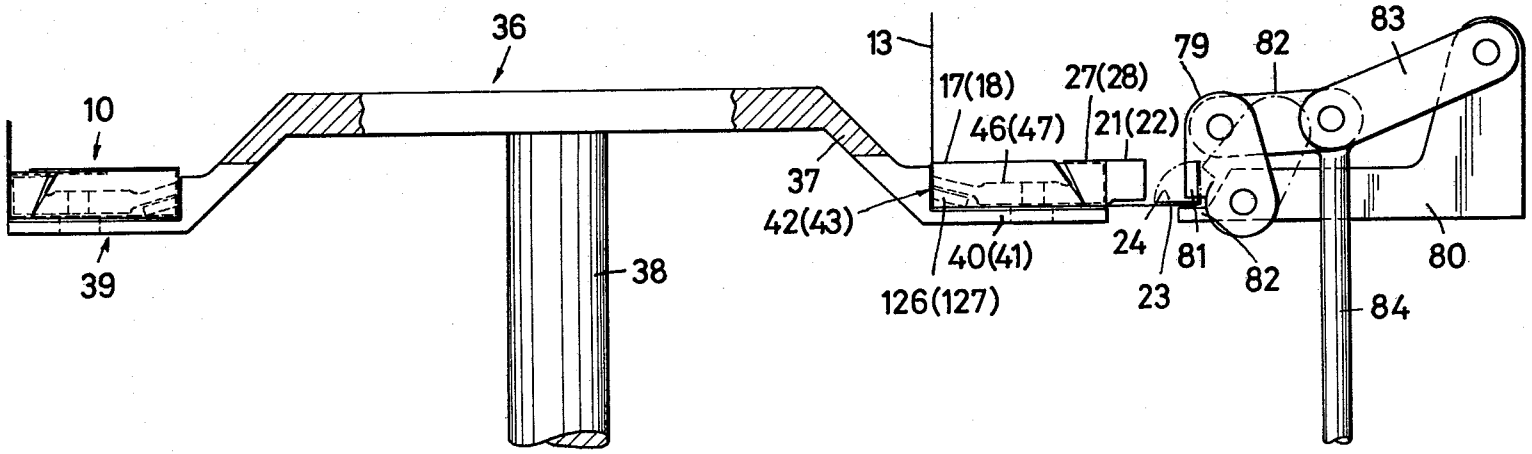
FIG. 7 is a cross-section through a folding turret with two diametrically opposite folding stations and folding tools for a folding station II.

The folding lever 79 is pivoted out of a radially and outwardly pivoted-back position (shown in chain dot lines) into the pressing position by a toggle lever linkage shown in FIG. 7 consisting of two levers 82, 83. In the zone of the pivotable connection of the levers 82, 83 to one another, a thrust rod 84 engages which produces the aforedescribed folding movement by upward motion.

After this folding operation the pocket 39 is fed to folding station III, at which relatively complex folding and filling operations are performed.

At the folding station III shown in FIG. 9 the cigarette block 31 is introduced, with the previously added collar 33, in to the outwardly and upwardly open packet (blank 10). The cigarette block 31 is fed on a packet path 85 by a chain conveyor 86 and is seized with the not yet completely folded tinfoil blank 32 on the side to the rear, in the direction of conveyance, by entraining members 87 of the chain converyor, which convey the cigarette block 31 to a block platform 88 which transfers the block 31 to the pocket 39.

The block platform 88 can be horizontally reciprocated on guide rods 89 and is driven by a crank drive 90, 91.

The movements of the chain conveyor 86 and block platform 88 are so adapted to one another that the latter first runs contrarily to the chain conveyor and its entraining member 87. The cigarette block 31 is pushed on to the block platform 18 as a result. The final position of the block 31 on the platform 88 is reached when the speeds of the entraining members 87 and platform 88 are the same as one another, after the reversal of movement of the platform 88. Thereafter the speed of the platform becomes greater than that of the entraining member 87, so that the platform 88 with the block 31 moves away from the entraining member 87.

In the zone of transfer of the block 31 to the platform 88, a blank which at first is flat for the collar 33 is laterally fed to the block 31. This is done by a special collar conveyor (shown diagrammatically in FIG. 3) which feeds the collar blanks successively and intermittently. The collars are held in readiness above the platform 88 and block 31 on a special guide path (not shown to simplify the drawings). From the guide path the collar 33 is entrained by the block 31 moved transversely and radially.

On the platform 88, the block 31 is laterally secured by angular lateral retaining members 93, 94. The members 93, 94, angular in cross-section and extending from the end of the platform 88 engage over the top side of the block 31 via top webs 95, 96 on which retaining lugs 97, 98 are disposed which positively enter a recess **33*a* in the collar 33 in such a way that the collar 33** is fixed both against the direction of conveyance and also laterally.

Disposed on the platform 88 are folding tools which fold those parts of the tinfoil blank 32 which project on the rear side of the block 31. They are lateral folding-in members 99, 100 (one-armed levers) which are mounted laterally on the platform 88 and can be pivoted against the rear end face and which by their bent folding ends fold over lateral end flaps 101, 102 of the tinfoil blank which project from the side in this zone.

The folding movement of the lateral folding-in members 99, 100 is controlled by fixed guide slots 103, 104 entered by guide rollers 105, 106 of the lateral folding-in members. In the zone where the guide slots 103, 104 are shown to bend, the inwardly directed folding movement of the lateral folding-in members 19, 100 takes place.

The bottom folder 107 pivotably mounted in the center below the platform 88 folds over a bottom longitudinal end flap 108 of the tinfoil blank 32. The foldings by the lateral folding-in members 99, 100 and the bottom folder 107 are performed during the movement of the platform 88. To simplify the drawings, the drive for the bottom folder 107 is not shown.

The end position of the platform 88 adjacent the turret 36 is shown in FIG. 9 by a chain line of the edge adjacent the turret. Before the platform 88 has reached such end position, the block 31 on the platform 88 is seized by its rear side by an introducing arm 109 (one-armed lever) mounted pivotably and horizontally reciprocably above the path of movement of the platform 88. The introducing arm 109 is disposed on a sliding member 110 which can be slid with the introducing arm 109 on sliding rods 111. The sliding member 110 and therefore the introducing arm 109 are driven in horizontal reciprocation by a crank drive 112, 113. The movements of the crank drives 90, 91 for the platform 88 on the one hand and 112, 113 for the introducing arm 109 on the other are so adapted to one another that, as the movement of the platform 88 slows down, in the end zone of the amplitude of movement the block 31 is seized at its side on the rear in the direction of movement by the lagging introducing arm 109 whose front end is lowered. The end of the introducing arm 109 which seizes the bock 31 takes the form of an angular member 114. The lowering movement of the angular member 114 at the same time folds over the still unfolded top longitudinal end flap 115 of the tinfoil blank 32 against the rear end face of the block 31, so that at the same time the block 31 is completely folded.

The introducing arm 109, accelerated by the characteristic movement of the crank drive 112, 113, pushes the block 31 off the platform 88, retarded towards the end of the phase of movement, into the pocket 39 of the turret 36 and into the partially folded blank 10.

Before the block 31 enters the folded blank 10, the block 31 passes through a movable mouthpiece 116 consisting of two halves 117, 118 each mounted on a pivoting arm 119. The free space between the two mouthpiece halves 117, 118 enables the introducing arm 107 running in the center to pass through.

Each of the mouthpiece halves 117, 118 has a top plate 120 and a bottom plate **120*a* between which the block 31 is guided. The lateral edges 121 facing the arriving block 31 are arcuate and sharpened in the direction of their edges. In this embodiment the side edges 121 act as folding-over members for the hitherto laterally projecting collar flaps 34, 35 of the collar 33. When the block 31 with the collar 33 passes through the mouthpiece 116, therefore, the flaps 34, 35 are folded against the lateral surfaces of the block 31**.

As the block 31 passes through, the mouthpiece 116 is so pivoted out of the initial position shown in solid lines in FIG. 8 that (shown by chain dot lines) the mouthpiece 116 is directed towards the pocket 39 and blank 10. Due to the pivoted-back starting position, the blank, together with its parts of the hinged lid 21 projecting radially outwardly beyond the pocket 39, can be moved unimpeded into the folding station III. As FIG. 9 shows, during the pivoting movement of the mouthpiece 116 into the position in alignment with the pocket 39, the parts of the blank 10 projecting outwardly beyond the pocket 39 are forced downwards. For reasons of simplicity, the drive of the mouthpiece 116 and halves 117, 118 is not shown.

After the block 31 has been completely inserted into the folded blank 10 by the introducing arm 109, as the turret 36 continues to move, first the rear, upright lid corner flap 29 is folded over by a rotating folding lever 122 (cf. also detail illustrated in FIG. **8*a*) against the outer end face of the block 31. During the folding movement the folding finger 122, which is disposed on a rotating arm 122*a*, is moved substantially in the direction of rotation of the turret 36 — i.e., it runs together with the partially folded packet, but in such a way that the lid corner flap 29 is folded by a relative movement. At the same time the flap 29 is fixed in the folded-over position by the folding finger 122 until the latter emerges in its path of movement from the zone of the packet. To make this folding movement possible, an arm 122*a* is disposed on a shaft 122*b* directed at an angle to the radial of the turret 36**.

Also during the further movement of the turret 36 the pocket 39 and therefore the folded blank 10 moves into the zone of a fixed outer guide 123. When the pocket 39 runs into the zone of the outer guide 123, the lid corner flap 30 at the front in the direction of movement is also folded over against the end face of the block 31.

In the zone of the folding station IV only the collar 33 disposed in the folding station III at a distance from the radially outer edge of the block 31 — i.e., offset in relation to its end position — is so displaced outwardly on the block 31 that the collar acquires its end position shown in solid lines in FIG. 3. To this end the packing machine has a suitable member (not shown), for instance, a horizontally reciprocable tappet.

At the folding station V two foldings are performed by folding members which are also known in principle and are therefore not shown. On the one hand the end wall 22 of the lid with the lid front wall 23 disposed thereon and the other parts of the hinged lid 21 are moved into an upright position. On the other the hitherto upright wall 13 of the blank, with the lateral flaps 14, 15 disposed thereon, is folded on to the top side of the block 31. The lateral flaps 14, 15 of the front wall 13 continue to remain in the plane of the front wall 13.

The pocket 39 with the blank 10 then moves to folding station VI, at which in the embodiment in question no foldings or other treatment of the blank 10 are performed.

The following folding station VII is also the ejection station for the packet folded to this extent. The first thing needed for ejection in the radial direction is that the stop arm 46, 47 of the pockets 39 are so pivoted that the retaining lugs 48, 49 are disengaged from the edges of the lateral flaps 17, 18. The necessary pivoting movement of the stop arms 46, 47 against the loading of springs (not shown) is performed by rotating cam discs 124, 125 which are disposed upright with a common axis of rotation directed substantially tangentially to the turret 36.

The cam discs 124, 125 act on the free ends of the stop arms 46, 47 (two-armed levers) on which supporting rollers 126, 127 are mounted with an axis of rotation at an inclination shown, for instance, from the side elevation illustrated in FIG. 11. The supporting rollers run up on segment-like protuberances 128 of the cam discs 124, 125 and are thereby so pivoted that the retaining lugs 48, 49 are lifted off the lateral parts of the blank 10.

The substantially folded packet 10 is then removed with its contents from the pocket 39, in the embodiment illustrated by a chain conveyor 129 whose entraining members 130 seize each of the packets by the radially inner front sides in the zone between the carriers 40, 41 of the pocket 39. A deflecting wheel 131 of the chain converyor 129 adjacent the turret 36 is mounted coaxially with the cam discs 124, 125, namely on the same shaft as the latter.

In the zone of the folding station VII, a packet path 132 adjoins the turret 36 in the radial direction. The packet path consists of a top guide 133 and bottom guide 134. When the blank 10 enters the packet path 132 by being conveyed by the chain conveyor 129, the hitherto upright lid front wall 23, with the laterally projecting outer gussets 25, 26 directed in the same plane, is folded over against the top side of the cigarette block 31.

The blank 10 then passes with laterally projecting lateral flaps 14, 15 and outer gussets 25, 26 through a glue applicator 135 in which glue is applied to the undersides of the lateral flaps 14, 15 and of the outer gussets 25, 26 between gluing rollers 136, 137.

After leaving the glue applicator 135 the laterally projecting parts of the blank 10 which are glued on the bottom side, namely the lateral flaps 14, 15 with their outer gussets 25, 26 are folded downwards by folding points 227 of known construction disposed laterally on the packing path 132 into an inclined position, but not yet until they bear against the already folded lateral flaps 17, 18 and inner gussets 27, 28.

At the end of the packet path 132 the packets 10, completely folded except for the obliquely placed lateral flaps 14, 15 and outer gussets 27, 28, are taken over by a packet lifting device 138 and fed to a transfer turret 139.

In this embodiment the packet lifting device 138 consists of two lifting plates 140, the packet 10 being received on their top sides, which is flush in the starting position with the bottom guide 134 of the packet path 132. On the rear side, viewed in the conveying direction, the top side of the lifting plates 140 has a stop 141.

The lifting plates 140 are fed by parallel displacement to the transfer turret 139. The latter can be rotated by a shaft 142 in a plane transverse of the packet path 132. To perform the horizontally reciprocating parallel movement of the lifting plates 140, two fixed pivotable parallel links 143, 144 are articulated between the lifting plates at their bottom edges. The parallel links 143, 144 are moved with the lifting plates 140 out of the bottom starting position shown in solid lines and chain lines into the top end position shown in chain dot lines. The packet borne on the top side of the lifting plates 140 at the same time performs a movement along the arc of a circle.

The packet lifting device 138 has a ratchet 241 which prevents the lifting device 138 from moving if faults, for instance, the absence of the tinfoil blank, is observed in a packet 10 fed. The ratchet 241 in this embodiment consists of a pivotable one-armed pawl 242 which engages positively in a recess 244 in the lifting device 138, namely the lifting plates 140. The pawl 242 is moved by a magnet 243 into the locking position shown in FIG. 12 and retained in such position. In the case of faulty packets 10, the tappet of the magnet 243 is withdrawn and the pawl 242 disengages from the recess 244. The faulty packets are conveyed further on the packet path 132, as shown on the left in FIG. 12.

The packet lifted by the packet-lifting device 138 off the packet path 132 is received by one of the cells 146 of the transfer turret 139. The transfer turret 139 is constructed as a double turret, each cell 146 having two compartments 147, 148 disposed one beside the other in the radial direction. The packets fed by the packet lifting device 138 are each received by the radially inner compartments 147 of the cells 146. The lateral flaps 14, 15 previously folded into an inclined position and the outer gussets 25, 26 are forced against the packet in the cells 146.

The structure of the cells 146 is shown in detail in FIG. 14, illustrating how each cell 146 consists of two walls 149, 150 which can move in relation to one another. The compartments 147, 148 are divided from one another by rib-like projections 151, 152 on the insides of the walls 149, 150. The outer compartment 147 is bounded in the outward direction only in the zone of the wall 150 by a rib-like projection 162. The inner boundary of the cells 146 in the radial direction is formed by a turret base member 153 having in the zone of the cells 146 T-shaped widening plates 154. The projections 151, 152 separating the compartments 147, 148 are of different thickness, so that the blanks 10 or packets are received in the cell 146 at an angle to one another.

The walls 149, 150 can move relatively to one another to receive and release packets 10. Each wall 149, 150 can pivot around a fixed axis 155, 156. The walls 149, 150 are pivotably mounted on the pivots 155, 156 by arms **157, 157*a* 158, 158*a* extending fork-shaped out from the walls at a distance from one another. The arms 157–158*a* are disposed spaced out on the pivots 155, 156**.

The walls 149, 150 are acted upon by a cam disc 159 to open and close the cells 146. To perform the opening and closure movements, the disc 159 is rotated backwards and forwards relatively to the transfer turret 139 and concentric therewith. The walls 149, 150 and their actuating arms 157, 158 have laterally projecting actuating rollers 160, 161 on the ends prolonging the arms of the pivots 155, 156. The actuating rollers 160, 161 transmit the opening and closure movements of the walls 149, 150 from the cam disc 159.

In the embodiment illustrated only the actuating arms 158 of the walls 150 bear by their actuating rollers 160 against the periphery of the cam disc 159. Each of the actuating arms 157 of the walls 149 bear via their actuating arms 161 against the actuating rollers 160 of the adjacent walls 150. Acting on the actuating rollers 160 transmits the pivoting movement similarly via the actuating roller 160 to the adjacent wall 149. The arrangement is such that a cam-like proturberance of the cam disc 159 produces a pivoting of the walls 149, 150 in the expanding — i.e., opening direction. The walls 149 and 150 are returned in this embodiment to the starting position by a compression spring 228 borne between the facing walls 149, 150 of adjacent cells 146.

As shown more particularly in FIG. 14, the turret basic member 153 is stellate. In the zone of the radial projections the T-shaped widening plates 154 are provided as an inner boundary of the cells 146. Another feature can be seen; each cell 146 has an aligning web 229 associated with it. The aligning web 229 secures the completely folded packet in the radially inner compartment 148 against undesirable transverse movements and parallel deformations. The very thin-walled aligning web 229, which in this embodiment is disposed on the arm **158*a* of the wall 150, extends through a gap 230 in the widening plate 154 and in this embodiment enters a joint 231 formed in the packet between the hinged lid 21 and the packet body. The packet is secured in the cell by this positive engagement of the aligning web 229 in the joint 221**.

After the aligning web 229 has entered the joint 231 plate punches 245, 246 act on the two free end faces of the packet 10. The plate punches 245, 246 move the hinged lid 21 into the proper closure position in relation to the remaining part of the packet 10, so that only the narrow joint 231 remains. The packet 10 is also adjusted by the plate punches 245, 246 in relation to the aligning web 229.

When the cell 146 is opened, the aligning web 229 disposed on the arm **158*a* is forced out of the joint 231**.

The packets 10 received in the inner compartments 148 of the transverse turret 139 are fed via a short conveying path to a drying turret 163.

The drying turret 163 retains the packets 10 until the glued places have dried. The drying turret 163 has a plurality of chambers 164, each receiving one packet. FIG. 15 shows details of the construction of the drying turret 163, which is disposed with its axis parallel with transfer turret 139, but with an offset in the axial direction such that in a partial zone the two turrets 139, 163 register with one another. The registration is such that in the zone of the coaxial position of the cells 146 of the transfer turret 139 with the chambers 164 of the drying turret, the relative position of the cells 146 and compartments 147, 148 in relation to the chambers 164 is such that the packets can be transferred from the inner compartments 148 to one of the chambers 164 without rotation, merely by axial displacement. The packets are transferred from the transfer turret 139 to the drying turret 163 by a pusher 65 which performs the pushing movement in the axial direction.

During almost one complete rotation of the drying turret 163 the packets 10 remain in its chambers 164.

The packets 10 are then returned to the transfer turret 139 at substantially the same place as that at which the packets were taken over by the drying turret 163. While the packets 10 are transferred from the radially inner compartments 148 of the cells 146 of the transfer turret 139 to the drying turret 163, return from the drying turret 163 to the transfer turret 139 takes place in the zone of the radially outer compartments 147.

To eject the packets 10 from the chambers 164 of the drying turret 163 an ejecting member 166 is provided which extends via two thrust rods through apertures 167, 168 in the closed rear wall of the chamber 164. The ejecting member 166 is connected via an arm 169 to an axially displaceable thrust rod 170 which lies axially central in relation to the drying turret 163. The ejecting member 166 and the pusher 165 operate simultaneously, so that in the zone of the registration and substantially identical position of the compartments 147, 148 of the transfer turret 139 on the one hand and the chambers 164 of the drying turret 163 on the other, at the same time one packet 10 is received by the drying turret 163 and one packet is ejected thereby.

The transfer turret 139 conveys the finished folded, closed packets 10 in the radially outer compartment 147 as far as ejection station 171. During transportation of the finished packet, extending in this case over the majority of the zone of rotation of the transfer turret 139, a control mark 172 can be applied to the outside, as illustrated. The device used for this can be of a known construction and is not shown in detail, for reasons of simplicity. The control mark 172 is so applied that a projecting length is formed which is folded over against the lateral surface of the packet 10.

In the zone of the ejection station 171 the packet 10 is transferred from the transfer turret 139 to a packet conveyor 173 consisting in this embodiment of two conveyor belts 174, 175, between whose facing runs the packets 10 are received without any change in the relative position in relation to the transfer turret 139. When the packets 10 are inserted in the zone between the conveyor belts 174, 175, the upwardly extending projecting member of the control mark 172 is folded over against the lateral surface of the packet 10.

As shown more particularly in FIGS. 13 and 15, the packet conveyor 173 terminates laterally alongside the transfer turret 139. The packets are pushed out of the compartment 147 of the transfer turret 139, by a horizontally reciprocable pusher 176 whose axis is parallel with the transfer turret 139, on to a fixed intermediate platform 177 from which the packet 10 is introduced by a piston 178 on to the packet conveyor 173.

The monitoring device is associated with the transfer turret 139; the monitoring device recognises and separates any packets which have no control mark 172 (or some other wrapper). In the present instance, a photoelectric cell 233 is associated with a station of the transfer turret 139, the cell 233 registering the absence of a control mark 172 and preventing the actuation of the pusher 176, though that particular packet 10 remains in the ejection station 171 in the cell 146 of the transfer turret 139. The ejection station 171 is followed by repelling points 239 which enter the zone of the cells 146 and guide the packet 10 out of the cell 146 opened in the this zone on to a belt 240.

The transfer turret 139, the drying turret 163 and the packet conveyor 173 are in driving connection with one another. The drive, from a common drive source, is transferred to a hollow shaft 179 of the transfer turret 139. Mounted in the hollow shaft 179 is a shaft 180, which can be driven independently of the hollow shaft 170, for the cam disc 159.

Disposed on the hollow shaft 179 is a gearwheel 181 for driving a shaft 182 of the packet conveyor 173 via a chain drive. Another gearwheel 183 of the hollow shaft 179 meshes with a transmission wheel 183 on a hollow shaft 184 associated with the drying turret 163.

If hot-melt adhesives which dry quickly are used, the drying turret 163 can be eliminated. In that case the transfer turret 139 is modified as against the construction illustrated in FIGS. 13 and 14. The cells 146 have only one compartment 148, namely the radially inner one. It has the same shape and size as the radial outer compartment 147 in the construction illustrated in FIGS. 13 and 14. The rest the transfer turret is constructed in the same way as in the embodiment illustrated. However, the design of the cam disc 159 allows for the fact that there is no opening of the cells 146 in the zone of a drying turret.

The occurrence of faulty packets, which are separated in the zone of the packet part 132 and packet lifting member 138 causes gaps in the packets in the rest of the system. As shown in FIG. 13, an after-laying shaft 247 is associated with the drying turret 160, or if there is no drying turret, with the transfer turret 139. The after-laying shaft 247 contains a relatively large number of properly made packets 10 which if required, namely if the chambers 164 of the drying turret 160 are empty, are supplied by a transversely operating introducing member 248 which can be controlled, for instance, by a photoelectric scanning device.

The apparatus described hereinbefore is used for manufacturing boxes to take one block-shaped article, more particularly a single cigarette block 31. However, without essential operation the apparatus can also be used for manufacturing cigarette packets or the like with a double block. Such known boxes with hinged lids do not differ as regards the construction and folding geometry of the blank from the embodiment described hereinbefore. Merely the blank is wider than shown in FIG. 1.

However, there is a difference in the collar 185 required for a packet with two cigarette blocks. The collar 185 (cf. FIG. 16) comprises two cover flaps 186, 187, each lying on a cigarette block, the collar flaps 188, 189 which can be folded against the outer lateral surfaces of the two cigarette blocks, and two adjoining central flaps 190, 191 which are folded inwards in V-shape until they bear against one another and forming the finished packet a separating web between the closely adjoining cigarette blocks 192, 193.

In this packing machine it is essentially only the arrangement of the folding station III which differs from the construction disclosed hereinbefore.

The two cigarette blocks 192, 193 are fed to the folding station III simultaneously, lying aligned one beside the other, but still at a relatively large distance from one another, on a common block path 194. In this case also, as in the embodiment disclosed hereinbefore, the cigarette blocks 192, 193 are not yet completely folded. The rear bottom and top longitudinal end flaps 195, 196 and the lateral end flaps 197, 198 project beyond the cigarette groups and must be folded for completion against the rear end face of the cigarettes.

The packing path 194 is subdivided. It consists of three individual paths which are bounded against one another by slots 199, 200 through which the entraining members 201, 202 pass of a common chain conveyor 203 running below block path 194. The two entraining elements 201, 202 are interconnected via a web 204.

As in the preceding example, the two cigarette blocks 192, 193 are pushed in the relative position to one another given on the block path 194 on to a correspondingly wider block platform 205. FIGS. 17–19 do not show the horizontally reciprocating drive of the platform 205, but it can be constructed in the same way as the drive of the platform 88.

After the cigarette blocks 192, have been taken over by the platform 205, the spread-out blank of the collar 185 is fed in the same way as in the preceding embodiment.

Mounted on the platform 205 are two pivotable retaining angles 206, 207. They are each mounted displaceably on fixed pins 208, 209 of the platform 205 transversely of the conveying direction of the cigarette blocks 192, 193. The retaining angles 206, 207 are disposed with sliding bearing sleeves 210, 211 on the pins 208, 209.

After the blocks 192, 193 have been pushed on to the platform 205, the retaining angles 206, 207 loaded by tension springs 212, 213 in the direction of an outer end position (namely directed towards the sides of the platform 205) engage around the blocks 192, 193 at their outer edge zones, including a portion of the outer lateral surfaces.

Disposed on the top side of the retaining angles 206, 207 are angular retaining webs 214, 215 which positively enter corresponding recesses 232, 233, pointing rearwardly in the conveying direction, of the spread-out collar 185. As a result, the collar 185 is fixed on the top side of the retaining angles 206, 207 against lateral movements and movement in the rearward direction.

The platform 205 is then moved out of the position adjacent the block path 194 (lower half of FIG. 17) in the direction of the turret 36. The result during the course of the movement is inter alia an intermediate position (top half of FIG. 17). In this position, or during the movement of the platform 205 into such position, the cigarette blocks 192, 193 are pushed together until they bear against one another and bear against the web formed by the central flaps 190, 191 of the collar 185. This transverse movement of the two cigarette blocks 192, 193 is performed by the retaining angles 206, 207, which perform a sliding movement on the pins 208, 209 against the tension springs 212, 213. The retaining angles 206, 207 are acted upon by lateral pressure levers 206, 207 to perform this movement. The pivotable pressure levers 216, 217 each bear via a pressure roller 218 against the adjacent outside of the upright flange of the retaining angles 206, 207.

The aforementioned pivoting movement of the pressure levers 216, 217 is produced by a fixed control slide 219, 220. A control pin 221 for the pressure levers 216, 217 runs in the control slides 219, 220, disposed, for instance, on the machine frame or table. The guide slides 219, 220 extend in such a manner that in the zone of the position of the platform 205 shown in the top half of FIG. 17, the pressure levers 216, 217 are pivoted inwards and the retaining angles 206, 207 with the blocks 192, 193 are shifted correspondingly.

In the embodiment under discussion the pressure levers 16, 17 form part of lateral inward folding members 221, 222 which fold the outer lateral end flaps 197 of the two blocks 192, 193 inwards and are actuated simultaneously with the retaining angles 206, 207, namely so pivoted inwards against the rear end face of the blocks 192, 193 that the outer lateral end flaps are pivoted into the position shown in the top half of FIG. 17 in the manner already described.

When the blocks 192, 193 are pushed together, the collar 185 lying on the top side of the retaining angles 206, 207 is folded. The central flaps 190, 191 already slightly folded in V-shape against one another previously, namely conveniently before the application of the blocks 192, 193, are then completely folded between the two blocks 192, 193, as a result of the two cover flaps 186, 187 being entrained by the retaining webs 212, 213.

While the two blocks 192, 193 are being moved together by transverse movement, a centrally disposed folding member 223 has been moved out of the starting position adjacent the block path 194 (bottom half of FIG. 17) into the position illustrated in the top half of FIG. 17. The folding member 223 is disposed on the top end of carrying arm 224 which is horizontally reciprocated between the two positions by a suitable drive and is so moved in correspondence with the platform 205 moved in the direction of the turret 36 as always to produce a relative position of the folding member 223 in relation to the platform 205 and blocks 192, 193 such as is shown in the top half of FIG. 17.

The folding member 223 is at the height of the blocks 192, 193. The constructional height of the folding member 223 is slightly smaller than that of the blocks 192, 193. In the aforementioned relative position of the folding member 223, the rear end face of the blocks 192, 193 can be moved closely past that folding surface of the folding member 223 which is at the front in the conveying direction. This transverse movement of the blocks 192, 193 in relation to the folding member 223 causes the latter to fold the inner lateral end flaps 198 of the two blocks 192, 193.

The bottom and top longitudinal end flaps 195, 196 of the blocks 192, 193 must then be folded. For the bottom longitudinal end flaps 195 bottom folders can be provided on the platform 205, as described in connection with FIG. 9.

In this case also the folding of the top longitudinal end flap 196 and therefore the further conveying of the blocks 192, 193 is performed in the same manner as at the folding station III (FIGS. 8 and 9). The blocks 192, 193 are seized by a common introducing arm corresponding to the introducing arm 109 (or introducing arms associated with each block) and fed from the platform 205 to the pocket 39 of the turret 36, accompanied by the folding-over of the top longitudinal end flap 196. In the zone of the end phase of movement of the platform 205 the retaining angles 206, 207 are pivoted back into the starting position, so that the blocks 192, 193 can be freely ejected.

Disposed in the edge zone on the platform 205, on the side adjacent the turret 36, are stop blocks 234, 235. They are of very low constructional height and form a boundary for the relative position of the blocks 192, 193 when the latter are pushed on to the platform 205 in starting position. Due to the dimensions of the stop blocks, the pushed-together cigarette blocks 192, 193 can leave the platform 205 unimpeded, through between the stop blocks.

On their way from the platform 205 to the pocket 39, the cigarette blocks 192, 193 so pass through a suitably dimensioned mouthpiece, corresponding to the mouthpiece 116 illustrated in FIG. 9, that the laterally projecting collar flaps 188, 189 are folded in the manner described against the outer lateral surfaces of the cigarette blocks 192, 193.

The other movements and folding operations correspond to those in the embodiment already described.

In the embodiment of the transfer turret 139 illustrated in FIG. 13 a conventional wrapper or control mark 172 is applied to the packet, bearing against its front and end faces. Alternatively the apparatus can have a device for applying a strip wrapper 250 (FIGS. 20, 21). A strip wrapper 250 of this kind extends over the whole length of the end face and bears via its ends against the narrow lateral surfaces of the packet.

An embodiment of the device for applying the strip wrapper 250 is shown in FIGS. 20 and 21. Mounted laterally alongside the transfer turret 139, preferably in the zone of the cell 146 shown at the top of FIG. 13, is a wrapper applying device 251 comprising of an intermittently rotating stellate disc 250 whose outer periphery has radially projecting uniformly spaced-out attachments 253 on whose outer ends suction strips 254 pointing in the axial direction are disposed. A suction channel 255 has a number of bores for discharge at the outer surface. The suction channel 255 is connected via the attachment 253 in the zone of the rotary disc 252 to an annular channel 257 of the fixed control disc 258. The annular channel 257 is connected to a negative pressure source. Associated with the wrapper-applying device 251 is a fixed wrapper magazine 259 from which the spread-out strip wrappers 25 can be removed individually by a suction strip 254.

The radially outer sides of the strip wrapper 250 are glued in the zone of a fixed glue-applying roller 260.

The wrapper applying device 251 thus constructed is disposed at a lateral distance alongside the transfer turret 139. In the zone of the suction strip 254 (directed to the right in FIG. 20) the glued strip wrappers 250 are fed to the end wall 22 of the hinged lid 21. To this end, with the transfer turret 139 stationary, the packet 10 in question is ejected by a transversely operating pusher 261 out of the cell 146 or radially outer compartment 147 in the axial direction until it bears against the strip wrapper 250 and suction strip 254. As a result the strip wrapper 250 is delivered to the packet 10, which is conveyed onwards by the transfer turret 139 in the relative position illustrated in FIGS. 20 and 21.

In the zone of the ejection station 171 the laterally projecting ends of the strip wrapper 250 are folded over against the lateral surfaces of the packet. To this end, in contrast with the embodiment illustrated in FIG. 13, at the ejection station 171 the packet conveyor 173, with its conveyor belts 174, 175, is further extended in the direction of the axis of rotation of the transfer turret 139, so that the converyor belts 174, 175 terminate alongside the cells 146. When the packet is ejected transversely by the pusher 176, the packet is introduced directly into the zone between the conveyor belts 174, 175, as a result of which the projecting ends of the strip wrapper 250 are folded over. In this alternative the intermediate platform 177 and piston 178 can be omitted.

I claim:

1. In an apparatus for producing and filling hinged boxes from a foldable, blank, said blank having front, rear and end walls, side walls formed from lateral flaps, and a blank section forming a hinged lid; the improvement comprising: a rotating turret, said turret having a number of pockets; each pocket open radially outwards and upwards for receiving a blank, punch means for pressing said blank into a pocket, said punch means comprising a punch plate, wherein a free surface of said pocket is covered by said rear wall of the blank, means for folding said end wall, said front wall and side walls into an upright position on the radial inner side of said pocket and said lateral flaps into an upright position and wherein said blank sections forming the hinged lid lie in the same plane as the rear wall of said blank and contents are insertable in said pocket in a radial direction in the plane of said rear wall of the blank.

2. The apparatus of claim 1 including means for ejecting a partially folded packet from the turret and introducing said packet into a packing path, in which laterally projecting lateral flaps and outer gussets of said packet have glue applied to their undersides and folded against the lateral surfaces of the packing.

3. The apparatus of claim 1, including means for feeding a finished folded packet to a transfer turret which feeds said folded packets to a drying turret.

4. The apparatus of claim 3, including means for returning the folded packets from the drying turret to the transfer turret after drying and fed from the last-mentioned turret to a packet conveyor.

5. The apparatus of claim 1, in which the turret is adapted to rotate around a vertical axis and has radially outwardly and upwardly open pockets for receiving the blank sections and contents.

6. The apparatus of claim 5, in which the pockets of the turret are attached to the outer periphery of a flat horizontal, pot-shaped, disc.

7. The apparatus of claim 5, in which the pockets comprise two spaced-out carriers which are angular in cross-section and directed in parallel to radial, and the bottom, horizontal arms forming bearing surfaces of the blank and contents and having vertical arms which laterally bound the the folded-in blank or packet.

8. The apparatus of claim 7, including radially inner stops for the blank and contents, comprising corners formed on the horizontal arms.

9. The apparatus of claim 7, in which means are provided whereby the folded-in blank and contents is fixed in the pocket against radial relative movements, comprising corners on the horizontal arms against which the blank and contents bear.

10. The apparatus of claim 9, including disengageable stops, comprising pivotable stop arms on both sides of the carriers which in the fixing position bear via retaining lugs against one edge of the blank inclined vertical from the lateral flaps.

11. The apparatus of claim 10, including means to release the fixing of the blank in the pocket, whereby on the ejection of the contents the stop arms can be disengaged by pivoting, preferably by the bearing of the free ends of the stop arms with supporting rollers against a control member.

12. The apparatus of claim 11, in which the supporting rollers are mounted with an inclined axis of rotation on the stop arms.

13. The apparatus of claim 1, wherein blanks are fed to a first folding station of said rotating turret via a blank path which is disposed above the turret, said blank path comprising top and bottom guides for the blanks, an end stop determining the end of said blank path and aligning the blank with an appropriate pocket, said blank further aligned by an adjusting lever having a finger abutting the edge of the blank disposed at the rear of the conveying direction and aligned laterally by a pivotable lateral aligning member and opposite lateral stops.

14. The apparatus of claim 13, further comprising means for applying glue, during conveyance, to areas of the blank in the zone of the blank path.

15. The apparatus of claim 1, including means for seizing the blank said punch means and said punch plate engages the full area of the rear wall of the blank.

16. The apparatus of claim 15, in which said punch means can be so moved by a link drive that, wherein after moving downwards with the blank, the punch means is first moved radially outwardly and returned at a distance from the blank path to the top starting position.

17. The apparatus of claim 1, further including laterally fixed folding members for folding the end wall and lateral flaps of the rear wall with end corner flaps, into a vertical position by relative movement of said blank.

18. The apparatus of claim 17, further including laterally disposed lateral folders, which are directed substantially parallel with the pocket, converge downwardly, and extend substantially over the length of the rear wall including the cover corner flaps, and terminate immediately above the lateral boundary of the pocket.

19. The apparatus of claim 18, further including a fixed folding tongue adjoining the bottom guide of the blank path and disposed above the radial inner boundary of said pocket, the tongue extending out of the plane of the bottom guide with an arcuate course in the downward direction at a distance from the pocket.

20. The apparatus of claim 17, further including separate fixed folding tools for the end corner flaps, wherein in cooperation with the lateral folders of the folding tongue, the end corner flaps can be straightened up and folded with pivoting through 90° against the inside of the also raised end wall.

21. The apparatus of claim 1, wherein said apparatus includes, at a subsequent folding station, a folding lever for folding the inner flap of the hinged lid against its lid front wall and wherein said lever is a one-armed lever, with a folding lug.

22. The apparatus of claim 21, in which the pivotable folding lever can be operated by a thrust rod via a toggle lever linkage.

23. The apparatus of claim 1, including a subsequent folding station, wherein a cigarette block can be fed to and introduced into a partially folded package in the radial direction at said subsequent folding station by a previously folded collar bearing against the top side of the cigarette block.

24. The apparatus of claim 23, including means for feeding the cigarette block with a partially folded tinfoil inner blank, and during the final phase of the feed the tinfoil blank can be completely folded in the zone of the rear end face of the cigarette block, when viewed in the conveying direction.

25. The apparatus of claim 24, including means whereby the partially folded package can be faced spaced-out successively to a packet path and, for performing the rest of the conveying, can be pushed onto an intermediate conveyor, more particularly a horizontally reciprocating block platform.

26. The apparatus of claim 25, further comprising a conveyor for the cigarette blocks, whereby said block platform can be first moved oppositely from said conveyor on a packing path when a cigarette block is taken over by the block platform and, until the same speed and the same direction of movement of the block path is reached, the cigarette block is completely pushed onto the block path, whereafter the block platform can be moved on at a higher speed than the conveyor.

27. The apparatus of claim 26, in which the conveyor is a chain conveyor, whereby the cigarette block can be pushed onto the block path by entraining members.

28. The apparatus of claim 25, wherein during conveyance by the block platform, the cigarette block can be completely folded with respect to sections the tinfoil blank which project on the rear side.

29. The apparatus of claim 28, further including lateral folders on the block platform said block platform horizontally reciprocated by a crank, said lateral folders pivoted in relation to the block platform, for folding in lateral end flaps of the tinfoil blank and further comprising, below the cigarette block, a pivotable bottom folder for folding in the bottom longitudinal end flap of the tinfoil blank.

30. The apparatus of claim 29, further comprising lateral inward folding members moved on together with the cigarette block together with the block platform, said lateral inward folding members pivoted by fixed guide members.

31. The apparatus of claim 30, in which the lateral inward folding members can be controlled by fixed guide slots entered by guide rollers disposed on the folding members.

32. The apparatus of claim 28, in which a top longitudinal end flap of the tinfoil blank can be folded against the rearward end face when the cigarette block is pushed off the block platform, said folding being performed by an ejection member having an angular part.

33. The apparatus of claim 18, further comprising means for feeding a flat blank for forming a collar to a cigarette block transversely of the direction of movement and deposited on its top side, during the bearing of the cigarette block on a block platform.

34. The apparatus of claim 33, wherein the block platform has retaining means for momentarily fixing the blank for the collar in a relative position above the cigarette block, and retaining lugs disposed on the block platform on top, horizontal webs, of angular lateral retaining members for the cigarette block, said lugs entering into a recess in the blank for said collar.

35. The apparatus of claim 34, further including means disposed towards the end of the amplitude of movement of the block platform for seizing the cigarette block at the end face on the rear in the direction of conveyance, an ejection member comprising an introduction arm with an angular part, said angular part removable from the block platform and introduced together with the collor into the radially outwardly and upwardly open packet in the pocket.

36. The apparatus of claim 35, wherein before its entry in the partially folded packet, the cigarette block passes folding members for laterally projecting collar flaps, whereby such collar flaps can be folded over, out of the originally horizontal position, against the lateral surfaces of the cigarette box.

37. The apparatus of claim 1, further comprising a mouthpiece having two laterally disposed halves which have lateral, sharpened edges extending for continuously folding over collar flaps, during the conveyance of a cigarette block in relation to the mouthpiece.

38. The apparatus of claim 37, in which the mouthpiece amd mouthpiece halves can be so pivoted out of inclined starting position in to the horizontal position required for the passage of the cigarette block, that the hinged cover of said blank projecting outwardly beyond the outer boundary of the pocket, can be moved by the pivoting movement of the mouthpiece into an inclined position, preferably by a bottom plate.

39. The apparatus of claim 1, further including a horizontally reciprocable folding tool, said tool comprising: a folding finger disposed on the outer periphery of the turret, said folding tool applied to fold lid corner flaps at the rear in the direction of conveyance against the end face of a previously inserted cigarette block and, when the turret makes a further movement, said folding tool folds the lid corner flap at the front in the direction of conveyance also against the end face of the cigarette block by running past a stationary outer guide.

40. The apparatus of claim 1, including means ejecting the folded and filled packet in the radial direction from a further station and introduced into an adjoining packet path.

41. The apparatus of claim 41, further comprising stop arms, said stop arms pivoted out of engagement by cam discs which are controlled synchronously with an ejection member.

42. The apparatus of claim 41, further comprising a chain conveyor used as a detecting member for the packet, said chain conveyor having entraining members to seize the packet by the radially inside end face, the cam disc being mounted on a shaft together with a deflecting wheel for the chain conveyor.

43. The apparatus of claim 40, further including means cooperating with the ejection of the packet from the pocket of the turret which will fold the still upright cover front wall of the hinged lid, at the front in the direction of movement, against the packet so that the outer gussets of the hinged lid and the lateral flaps of the front walls are directed horizontally and flush with the top side of the packet.

44. The apparatus of claim 43, including a glue applicator in the zone of the packet path, the packet passing said glue applicator in which glue can be applied to downwardly-turned sides of the horizontally projecting lateral flaps and of the outer gussets of said packet.

45. The apparatus of claim 43, further including stationary folding points for folding the lateral flaps and the outer gussets in the zone of the packet path into a position inclined in relation to the lateral surfaces of the packet.

46. The apparatus of claim 1, including means to feed the packet formed by the association of the contents and the blank to a transfer turret and, via the transfer turret, to a drying turret.

47. The apparatus of claim 46, wherein the packets move along a packet path, said packets moved by a transfer device, comprising packet lifting mans from said path to the transfer turret which is disposed transversely of the packet path and which has along its periphery cells to receive the packets.

48. The apparatus of claim 47, in which the packet lifting device comprises two spaced-out lifting plates on the top side of which the packet is received, and which feed the packet, by parallel displacement by parallel links, along the arc of a circle from the packet path to a cell of the transfer turret.

49. The apparatus of claim 48, including means for locking the packet-lifting device whereby partially folded and filled packets with faults can be separated in the zone of the packet path, so that the packets to be separated can be conferred further on the packet path.

50. The apparatus of claim 49, wherein associated with the packet lifting device, is a ratchet which operates when a faulty packet is discovered and whose pawl enters a recess in the lifting plates in the locking position.

51. The apparatus of claim 46, including cells formed along the periphery of the transfer turret, said cells each having two radially spaced-out compartments, each receiving a packet.

52. The apparatus of claim 51, in which the cells are formed by walls lying in the peripheral direction and directed substantially parallel to the radial and which can be moved in relation to one another, apart and together to open and close the cells.

53. The apparatus of claim 51, including projections to limit the compartments on the facing sides of the walls in such a manner that the resulting compartments are directed at an angle to one another.

54. The apparatus of claim 51, including arms mounted on the walls to pivot on a common shaft.

55. The apparatus of claim 54, including an arm having an end beyond the shaft to pivot the walls apart with a control member, said control member comprising a cam disc mounted concentrically of the transfer turret, and on the outer periphery thereof, an actuating roller mounted on the end of the arm.

56. The apparatus of claim 55, in which the other wall has an end extending beyond the shaft, and an actuating roller mounted on such end against the actuating roller of the arm.

57. The apparatus of claim 52, further including means for moving the walls into a starting position, being the closure position, said means comprising a resilient compression spring disposed between adjacent walls of successive cells.

58. The apparatus of claim 51, wherein a packet fed from the packet path is introduced into a compartment of said cell on the inside in the radial direction and then introduced directly from such cell into said drying turret.

59. The apparatus of claim 51, including means for securing said packets disposed in a radially inner compartment of the cell against transverse displacements and parallelogram deformations, said means for securing comprising a thin-walled aligning web which approaches the packet from the inside of the transfer turret and which enters positively a joint of the packet between the body of the packet and the hinged cover.

60. The apparatus of claim 59, wherein said aligning web is disposed on an arm of the cell for movement together with such arm by pivoting into or out of engagement with the packet.

61. The apparatus of claim 59, further comprising plate punches, said punches actuating said packet in the zone where it is taken over by the transfer turret, upon the free end faces.

62. The apparatus of claim 51, in which the outer compartments are dimensioned such that there is no outer limitation on at least one of the walls, and wherein a dried packet received in the radially outward compartment extends by at least an edge zone out of the transfer turret, and means disposed on the outer periphery of the transfer turret to provide a control mark on said dried packet.

63. The apparatus of claim 62, further comprising a packet conveyor and wherein the control mark comprises a projecting part on one of the front and rear sides of the packet is folded over against a lateral surface of the packet by ejection of the cell of the transfer turret into said packet conveyor.

64. The apparatus of claim 46, wherein the transfer turret conveys the packets to said drying turret, said transfer turret also conveying the packets from the drying turret after a drying period to a packet conveyor.

65. The apparatus of claim 64, wherein said transfer turret has a plurality of cells, each cell having compartments disposed at an angle to one another such that, when the transfer turret partly registers with the drying turret, the compartments of each cell register with a radially directed chamber of the drying turret.

66. The apparatus of claim 65, further comprising means for extracting a packet from the compartment of the transfer turret for insertion into a chamber of the drying turret, while simultaneously a packet dried by rotating the drying turret through approximately 360° is introduced from a chamber into the radially outer compartment of a cell of the transfer turret.

67. The apparatus of claim 1, further comprising wrapper-applying means to apply a strip wrapper to the end wall of the hinged cover, and a transfer turret having cells therein.

68. The apparatus of claim 67, in which the wrapper supplying means holds in readiness an outwardly glued strip wrapper by means of a suction strip into which the packet can be supplied by axial displacement in the cell of the transfer turret.

69. The apparatus of claim 67, further comprising a wrapper magazine having wrapper strips, a rotating disc having three, equally spaced-out suction strips which successively each remove a strip wrapper from said wrapper magazine, said suction strips feeding said wrapper strips to a glue-applying roller and transferring said wrapper strips to the packet at a third station.

70. The apparatus of claim 1, for making a packet with two cigarette blocks, each packet wrapped in an inner, more particularly tinfoil blank, comprising means to feed said cigarette blocks together and simultaneously to a packing station and inserted into an upwardly and radially outwardly open, partially folded packet.

71. The apparatus of claim 70, further including means for feeding said cigarette blocks on a block part at an increased distance from one another to a folding station of the turret said cigarette blocks moved into a position close beside one another by transverse movement before entering the partially folded packet.

72. The apparatus of claim 71, further including means to push the cigarette blocks at an increased distance from one another, on to a suitably dimensioned block platform and control members to push said blocks together thereon accompanied by a transverse movement.

73. The apparatus of claim 72, in which the cigarette blocks on the block platform are retained by movable retaining means, comprising retaining angles, which feed the cigarette blocks at the outer lateral zones, laterally and on the top side.

74. The apparatus of claim 73, in which the retaining angles are transversely moveable on the block platform, entraining and pushing together the cigarette blocks.

75. The apparatus of claim 74, in which the retaining angles are axially displaceably, and elongated bearing sleeves on pins extending transversely of the direction of conveyance and rigidly mounted on one side of the block platform adjacent the turret.

76. The apparatus of claim 73, further including actuating thrust members for the transverse movement of the cigarette blocks, whereby the retaining angles can be acted upon by actuating thrust members, said thrust members comprising pressure levers, mounted on the block platform, against the loading of a resilient tension spring, the pressure levers being controllable from outside the apparatus.

77. The apparatus of claim 76, further including a control pin whereby the pressure levers are controllable in a pivoting movement, said control pin entering a fixed control slide disposed along the path of movement of the block platform that the retaining angles make their transverse movement during the conveying movement of the block platform.

78. The apparatus of claim 76, further comprising lateral inward folding members disposed on one pressure lever in the form of an elongation, said lateral inward folding members fold the outer lateral end flaps of the tinfoil blanks inwards during the transverse movement of the cigarette blocks.

79. The apparatus of claim 73, further comprising retaining webs disposed on the top side of the retaining angles for the cigarette blocks, said retaining webs due to their angular construction positively enter correspondingly disposed recesses on that side of the collar at the rear in the conveying direction.

80. The apparatus of claim 71, further comprising a folding member whereby the unfolded parts of the wrapping for the cigarette blocks, more particularly, the lateral end flaps facing one another, and projecting rearwardly in the conveying direction, can be folded by the moving together of the cigarette blocks in relation to said folding member which can change as regards transverse displacements and which folds the lateral end flap against the rear end face by a related transverse movement of the cigarette blocks.

81. The apparatus of claim 71, in which the separately movable folding member disposed on the rear side of the block platform can be so moved together with the block platform out of the starting position facing the block path that the relative position of the end performing the folding remains maintained during the movement of the block platform in relation to the cigarette blocks flush with the rear side of the block platform.

82. The apparatus of claim 70, in which retaining means are disposed on the block platform for a blank of a collar associated with the two cigarette blocks.

83. The apparatus of claim 70, further comprising a collar wherein in the starting position of the cigarette blocks spaced out from one another, the collar shared thereby covers said cigarette blocks, and the pushing together of the cigarette blocks can fold central flaps of the collar in V-shape between the cigarette blocks, to form a middle web, formed from the central flaps, between the cigarette blocks.

84. The apparatus of claim 83, including means whereby the central flaps are slightly pre-shaped in V-shape before the cigarette blocks are pushed together.

* * * * *